US009952533B2

(12) United States Patent
Ichikawa et al.

(10) Patent No.: US 9,952,533 B2
(45) Date of Patent: Apr. 24, 2018

(54) POWDER TRANSPORTING DEVICE INCLUDING REGULATED POWDER TRANSPORT MEMBER AND POWDER PROCESSING APPARATUS USING THE SAME

(71) Applicant: FUJI XEROX CO., LTD., Tokyo (JP)

(72) Inventors: Yuzo Ichikawa, Yokohama (JP); Takeo Fukai, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/254,268

(22) Filed: Sep. 1, 2016

(65) Prior Publication Data

US 2017/0277070 A1 Sep. 28, 2017

(30) Foreign Application Priority Data

Mar. 25, 2016 (JP) ..... 2016-062067

(51) Int. Cl.
*G03G 15/08* (2006.01)

(52) U.S. Cl.
CPC ..... *G03G 15/0812* (2013.01); *G03G 15/0891* (2013.01)

(58) Field of Classification Search
CPC ..... G03G 15/0812; G03G 15/0891; G03G 15/0877; G03G 15/0822; G03G 15/0893; G03G 15/0887; G03G 21/105
USPC ..... 399/358, 359
See application file for complete search history.

(56) References Cited

U.S. PATENT DOCUMENTS 6,085,062 A 7/2000 Mizuishi et al.

FOREIGN PATENT DOCUMENTS

| | | | |
|---|---|---|---|
| JP | 3565709 B2 | | 9/2004 |
| JP | 3741419 B2 | | 2/2006 |
| JP | 2007086169 A | * | 4/2007 |
| JP | 2007101949 A | * | 4/2007 |
| JP | 4655741 B2 | | 3/2011 |
| JP | 4730035 B2 | | 7/2011 |
| JP | 4857696 B2 | | 1/2012 |

* cited by examiner

*Primary Examiner* — Billy Lactaoen
(74) *Attorney, Agent, or Firm* — Oliff PLC

(57) ABSTRACT

Provided is a powder transporting device including: a powder transport path through which a powder loading port, from which powder is loaded in the path, communicates with a powder unloading port disposed with being shifted in a horizontal direction from a position perpendicularly below the powder loading port, and which has a lateral direction transport path and a longitudinal-direction transport path, is disposed to be bent with respect to the lateral direction transport path; a powder transport member that includes a lateral direction transport member, which is movable along the lateral direction transport path, and a longitudinal-direction transport member and that transports powder along the lateral direction transport path and the longitudinal-direction transport path; a drive input portion that leaves a rotational track; and a regulation member that regulates the behavior of the powder transport member.

14 Claims, 35 Drawing Sheets

83
111
68
69
72a
72d
72
72b
72d
65
81a (81)
107 (100)
101 (100)
81b (81)

83
111
68
69
72a
72d
72
72b
72d
65
81a (81)
101 (100)
107 (100)
81b (81)

POWDER TRANSPORTING DEVICE INCLUDING REGULATED POWDER TRANSPORT MEMBER AND POWDER PROCESSING APPARATUS USING THE SAME

CROSS-REFERENCE TO RELATED APPLICATIONS

This application is based on and claims priority under 35 USC 119 from Japanese Patent Application No. 2016-062067 filed Mar. 25, 2016.

BACKGROUND

Technical Field

The present invention relates to a powder transporting device which transports powder such as toner, and a powder processing apparatus using the same.

SUMMARY

According to an aspect of an exemplary embodiment of the invention, there is provided a powder transporting device including:

a powder transport path through which a powder loading port, from which powder is loaded in the path, communicates with a powder unloading port disposed with being shifted in a horizontal direction from a position perpendicularly below the powder loading port, and which has a lateral direction transport path extending in a transverse direction including at least a obliquely downward direction from the powder loading port and a longitudinal-direction transport path that is provided on the downstream side of the lateral direction transport path, is disposed to be bent with respect to the lateral direction transport path, and extends in a longitudinal direction including a vertical direction toward the powder unloading port;

a powder transport member that includes a lateral direction transport member, which is movable along the lateral direction transport path, and a longitudinal-direction transport member, which is coupled to the lateral direction transport member and is movable along the longitudinal-direction transport path, and that transports powder along the lateral direction transport path and the longitudinal-direction transport path;

a drive input portion that leaves a rotational track behind on the upstream side of the lateral direction transport member in a transporting direction of the powder; and a regulation member that is provided in an upper space facing the longitudinal-direction transport path of the powder transport path or in an upper half region of the longitudinal-direction transport path, and comes into contact with a regulation-target portion formed in a portion of the powder transport member so as to regulate the behavior of the powder transport member.

BRIEF DESCRIPTION OF THE DRAWINGS

Exemplary embodiments of the present invention will be described in detail based on the following figures, wherein.

DETAILED DESCRIPTION

Overview of Exemplary Embodiment

Figure 1A:
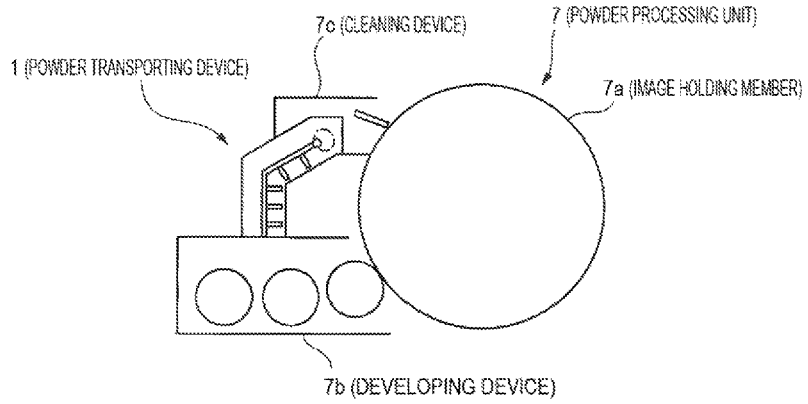
FIG. 1A is a view depicting an overview of an exemplary embodiment of a powder processing apparatus to which the invention is applied.

FIG. 1A illustrates an overview of an exemplary embodiment of a powder processing apparatus to which the invention is applied.

In FIG. 1A, the powder processing apparatus includes a powder processing unit 7 that performs processing using powder and a powder transporting device 1 that transports the powder that is used in the powder processing unit 7.

As an example of this type of powder processing apparatus, there is provided an aspect in which the powder processing unit 7 includes an image holding member 7*a* that holds an electrostatic latent image, a developing device 7*b* that develops the electrostatic latent image on the image holding member 7*a* using toner as the powder, and a cleaning device 7*c* that cleans residual toner off the image holing member 7*a*. An example of the powder transporting device 1 includes an aspect that is configured of a toner returning device that transports the toner as the powder cleaned by the cleaning device 7*c* and unloads the toner as reusing toner to the developing device 7*b*.

Figure 1B:
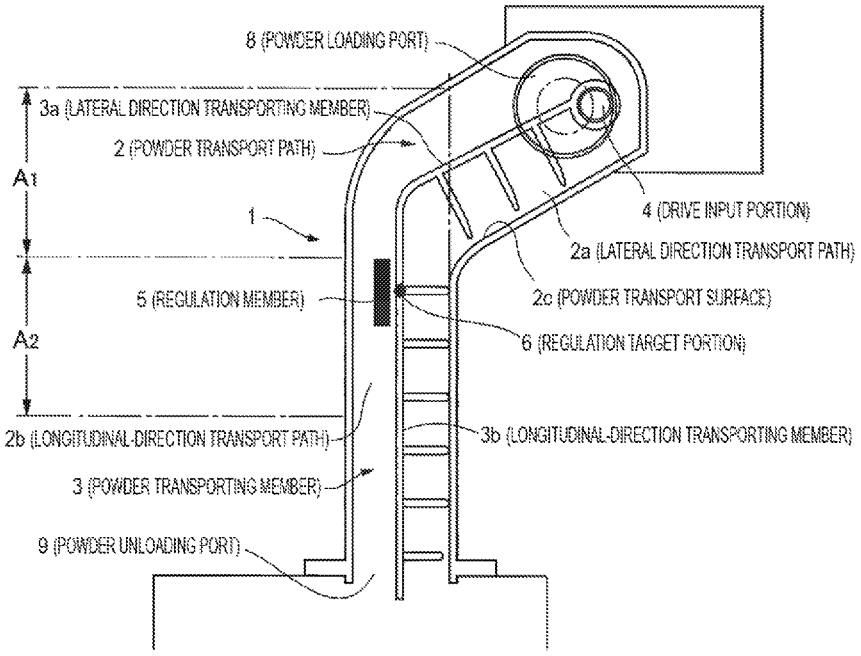
FIG. 1B is a view depicting a powder transporting device that is used in the powder processing apparatus in FIG. 1A.

In addition, in the present exemplary embodiment, as illustrated in FIG. 1B, the powder transporting device 1 includes a powder transport path 2, a powder transport member 3, a drive input portion 4, and a regulation member 5. Through the powder transport path, a powder loading port 8, from which powder is loaded in the path, communicates with a powder unloading port 9 disposed by being shifted in a horizontal direction from a position perpendicularly below the powder loading port 8, and the powder transport path has a lateral direction transport path 2*a* extending in a transverse direction including at least a obliquely downward direction from the powder loading port 8 and a longitudinal-direction transport path 2*b* that is provided on the downstream side of the lateral direction transport path 2*a*, is disposed to be bent with respect to the lateral direction transport path 2*a*, and extends in a longitudinal direction including a vertical direction toward the powder unloading port 9. The powder transport member has a lateral direction transport member 3*a*, which is movable along the lateral direction transport path 2*a*, and a longitudinal-direction transport member 3*b*, which is coupled to the lateral direction transport member 3*a* and is movable along the longitudinal-direction transport path 2*b*, and the powder transport member transports powder along the lateral direction transport path 2*a* and the longitudinal-direction transport path 2*b*. The drive input portion leaves a rotational track behind on the upstream side of the lateral direction transport member 3*a* in a transporting direction of the powder. The regulation member is provided in an upper space $A_1$ facing the longitudinal-direction transport path 2*b* of the powder transport path 2 or in an upper half region A2 of the longitudinal-direction transport path 2*b*, and comes into contact with a regulation-target portion 6 formed in a portion of the powder transport member 3, thereby regulating the behavior of the powder transport member 3.

In such technical means, as a precondition, there is provided an aspect, in which the longitudinal-direction transport path 2*b* is disposed to be bent with respect to the lateral direction transport path 2*a* in the powder transport path 2. Here, the lateral direction transport path 2*a* may have a portion extending in a transverse direction including at least an oblique downward direction, and the longitudinal-direction transport path 2*b* may have a portion extending in a longitudinal direction including a vertical direction.

In addition, the powder transport member 3 may include the lateral direction transport member 3*a* and the longitudinal-direction transport member 3*b* and may transport the powder into the powder transport path 2.

Further, the rotation track of the drive input portion 4 may be appropriately selected from a circular shape, an elliptical shape, or the like.

Furthermore, the regulation member 5 may be disposed at a position in the upper space $A_1$ facing the longitudinal-direction transport path 2*b* or in the upper half region A2 of the longitudinal-direction transport path 2*b*. It is preferable that the position is sufficiently separated from the drive input portion 4, and is closer to the lateral direction transport member 3*a* such that it is easy to regulate the behavior of the lateral direction transport member 3*a*. For example, since the upper space of the lateral direction transport path 2*a*, which faces a powder transport surface 2*c*, is very close to the drive input portion 4, there is a concern that contact pressure between the regulation member 5 and the powder transport member 3 will be increased. By comparison, in the case where the regulation member 5 is disposed in a lower half region of the longitudinal-direction transport path 2*b*, although the contact pressure with the regulation member 5 is decreased, it is difficult for the regulation member 5 to regulate the behavior of the lateral direction transport member 3*a*, because the regulation member is separated far away from the lateral direction transport member 3*a*.

In addition, the regulation member 5 comes into contact with the regulation-target portion 6 formed in a portion of the powder transport member 3, which widely includes regulation of the behavior of the powder transport member 3 to the desired behavior.

Next, a representative aspect and a preferred aspect of the powder transporting device according to the present exemplary embodiment will be described.

First, as a representative aspect of the regulation member 5, there is provided a regulation member that regulates the behavior of the powder transport member 3 such that the lateral direction transport member 3*a* comes into contact with the powder transport surface 2*c* of the lateral direction transport path 2*a* in a case where the lateral direction transport member 3*a* moves obliquely downward along the lateral direction transport path 2*a*, and, except for this case, the lateral direction transport member 3*a* is not in contact with the powder transport surface 2*c* of the lateral direction transport path 2*a*.

In addition, as a preferred example of disposition of the regulation member 5, there is provided an aspect in which the regulation member is provided at a position of the powder transport path 2, which is separated by a distance equal to or longer than a distance from the drive input portion 4 to a bent portion between the lateral direction transport member 3*a* and the longitudinal-direction transport member 3*b*. The example is preferable in that it is possible to secure a sufficient distance from the drive input portion 4 to the regulation member and the regulation member does not interfere with a dropping operation of the powder in the longitudinal-direction transport path 2*b*.

Further, as another preferred example of the disposition of the regulation member 5, there is provided an aspect in which the regulation member is provided in the powder transport path 2 in the vicinity of the bent portion between the lateral direction transport member 3*a* and the longitudinal-direction transport member 3*b*. The example is preferable in that the regulation member 5 is provided in the vicinity of the bent portion of both of the transport members 3*a* and 3*b*, whereby it is easy to regulate the behavior of the powder transport member 3 to the desired behavior around the vicinity of the bent portion. In addition, in a case where the regulation member 5 is disposed on the downstream side of the bent portion, the behavior of the longitudinal-direction transport member 3*b* needs to be regulated within the longitudinal-direction transport path 2*b* and thus, it should be noted that a posture of the powder transport member 3 is significantly changed.

Furthermore, as still another preferred example of the disposition of the regulation member 5, there is provided an aspect in which the regulation member is provided above the lowermost position that is reached by the regulation-target portion 6 formed in a portion of the lateral direction transport member 3*a*. In the example, the regulation-target portion 6 moves while engaging with the regulation member 5; however, when the regulation-target portion 6 runs over a lower end of the regulation member 5, the regulation-target portion 6 is not strongly caught on the regulation member 5, but smoothly passes below a lower end portion of the regulation member 5.

In addition, as a representative example of the regulation member 5, there is provided an aspect in which the regulation member is provided on a wall surface, which partitions the powder transport path 2, and engages with the regulation-target portion 6 formed in a portion of the powder transport member 3 so as to regulate the behavior of the powder transport member 3. In the example, the regulation member 5 is provided on the wall surface, which partitions the powder transport path 2, and engages with the regulation-target portion 6 of the powder transport member 3 in the aspect. Then, the regulation member 5 may be provided to be integral to the wall surface or may be fixed thereto as a separate member.

Further, as another representative example of the regulation member 5, there is provided an aspect in which the regulation member is configured of a protrusion protruding from the will surface, which partitions the powder transport path 2, and causes the regulation-target portion 6 formed in a portion of the powder transport member 3 to move around the protrusion so as to regulate the behavior of the powder transport member 3. In the example, the protrusion as the regulation member 5 is provided on the wall surface of the powder transport path 2.

Furthermore, as still another representative aspect of the regulation member 5, there is provided an aspect, in which the regulation member is configured of a recessed groove portion along a predetermined circulation track in a wall surface, which partitions the powder transport path 2, and causes the regulation-target portion 6 formed in a portion of the powder transport member 3 to move along the groove portion so as to regulate the behavior of the powder transport member 3. In the example, the groove portion as the regulation member 5 is provided on the wall surface of the powder transport path 2.

In addition, as a preferred aspect of the regulation member 5, there is provided an aspect in which the regulation member is configured of a protrusion protruding from the wall surface, which partitions the powder transport path 2, and a cross-sectional shape of the protrusion is changed, whereby engagement with the regulation-target portion 6 formed in a portion of the powder transport member 3 is adjusted. The aspect is an example in which the cross-sectional shape (for example, a triangular shape in a part of a cross section) of the protrusion as the regulation member 5 is changed, whereby it is possible to adjust the behavioral track of the powder transport member 3.

Further, as another preferred aspect of the regulation member 5, there is provided an aspect in which the regulation member is provided on the wall surface, which partitions the powder transport path 2, and engages with the regulation-target portion 6 formed in a portion of the powder transport member 3 with a track having a curved shape or a corner with an obtuse angle. The aspect is an example in which the protrusion or the groove portion as the regulation member 5 engages with the regulation-target portion 6, whereby the track having the curved shape or the corner with the obtuse angle is formed. For example, in an aspect in which the regulation member 5 has a track having a corner with an acute angle, it is easy for the regulation-target portion 6 to be caught on the corner having the acute angle, but there is a concern that the engagement between the regulation member 5 and the regulation-target portion 6 will not be smoothly performed. However, in the example, it is preferable that the engagement between both of the member and the portion is smoothly performed.

In addition, as still another preferred aspect of the regulation member 5, there is provided an aspect in which the regulation member is provided on the wall surface, which partitions the powder transport path 2, engages with the regulation-target portion 6 formed in a portion of the powder transport member 3, and is provided with a pressing member (not illustrated) that engages with the regulation member 5 and the regulation-target portion 6. In the example, the regulation member 5 and the regulation-target portion 6 engage with the pressing member, whereby both of the member and the portion is prevented from being released from the engagement.

(First Exemplary Embodiment)

Hereinafter, an exemplary embodiment of the invention will be described based on an exemplary embodiment illustrated in the reference figures.

—Entire Configuration of Image Forming Apparatus—

Figure 2:
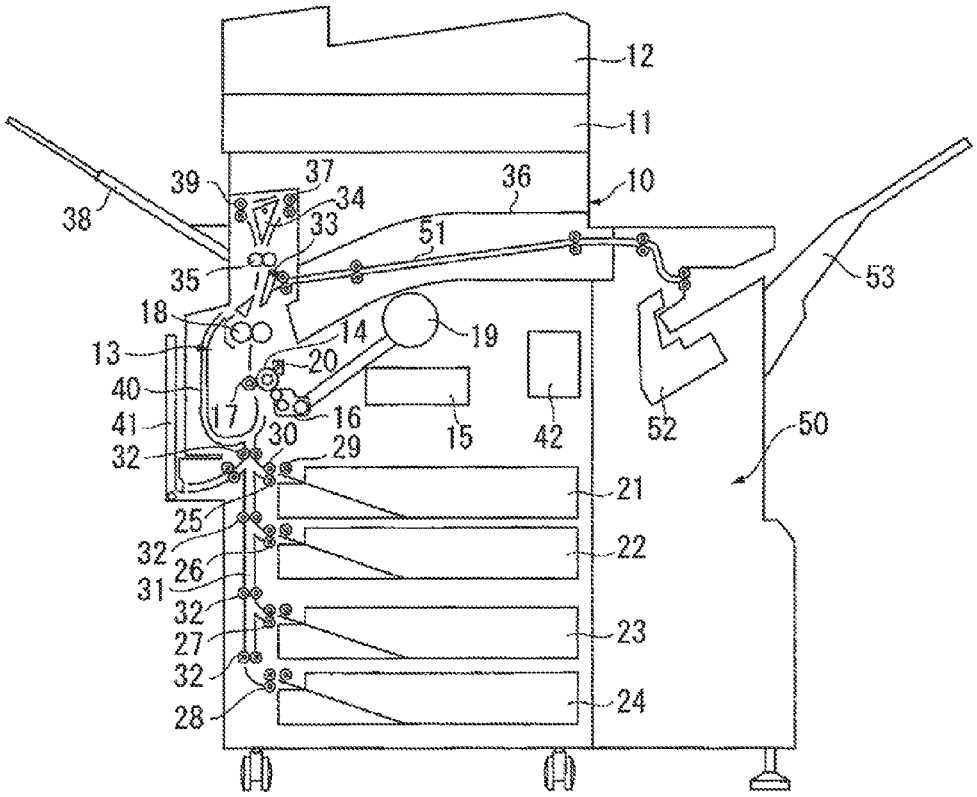
FIG. 2 is a view depicting an entire configuration of an image forming apparatus as the powder processing apparatus according to a first exemplary embodiment.

FIG. 2 is a schematic configuration diagram illustrating an image forming apparatus according to the present exemplary embodiment. Here, the inside of the apparatus is viewed from the front side.

The image forming apparatus illustrated in FIG. 2 includes an image forming apparatus main body 10 that forms an image using an electrophotographic process, an original document reading device 11 that reads an original document, and an automatic document feeder 12 that transports the original document to a reading position of the original document reading device 11. In the image forming apparatus main body 10, a toner image is formed by an image forming unit 13 by using image data output from the original document reading device 11 and image data output from a PC or the like (not illustrated), the toner image is transferred to a sheet (recording material) and then is fixed, and then, a print image is output.

In the example, the image forming unit 13 includes a photoconductor 14 having a drum shape for holding a toner image, an exposure device 15, such as a laser scanning device, which exposes the charged photoconductor 14, a developing device 16 that develops an electrostatic latent image on the photoconductor 14, which is formed by being exposed by the exposure device 15, a transfer device 17 (transfer roll type in the example) that transfers, to a sheet, the toner image developed by the developing device 16 and held on the photoconductor 14, a fixing device 18 that fixes, to the sheet, the toner image transferred by the transfer device 17, and a cleaning device 20 that removes and collects toner remaining on the photoconductor 14.

Here, the toner used in the developing device 16 is supplied to the developing device 16 from a toner supply bottle 19. In addition, the present exemplary embodiment employs a configuration in which the cleaning device 20 removes and collects the residual toner on the photoconductor 14 after the transfer of the toner image to the sheet and the removed and collected residual toner is again supplied to the developing device 16.

In addition, the image forming apparatus main body 10 is provided with a series of sheet transport system and thus, sheet accommodating containers 21, 22, 23, and 24 that accommodate sheets are built into the inner side of the image forming apparatus main body 10. The sheet accommodating containers 21, 22, 23, and 24 are provided with sheet supply mechanisms 25, 26, 27, and 28 that supply a sheet, respectively, and the sheet supply mechanisms feed the sheet toward a sheet transport path 31 from the sheet accommodating containers 21, 22, 23, and 24.

In the sheet transport path 31, a transport roll 32 provided in the vicinity of the sheet supply mechanisms 25 to 28, switching gates 33 and 34 that switches transporting directions of the sheet in the vicinity of an exit portion of the image forming apparatus main body 10, a transporting roll 35 provided between the switching gates 33 and 34, an exit roll 37 that causes the sheet to exit facedown (a state in which a recording surface is mounted downward) to an exiting sheet receiver 36, and an exit roll 39 that causes the sheet to exit faceup (a state in which a recording surface is mounted upward) to an exiting sheet receiver 38. In addition, there is provided a sheet reverse transport path 40 for reversing, in a transfer portion (contact portion between the photoconductor 14 and the transfer device 17), the sheet having one surface on which the recording is performed, in a case of duplex recording on the sheet. In addition, an openable and closable manual feed tray 41 for supplying a size or type of sheet, which is not contained in the four sheet accommodating containers 21 to 24, is provided on a side surface of the image forming apparatus main body 10. Further, the image forming apparatus main body 10 includes a controller 42 that controls the entire apparatus regarding sheet transport, image forming, and the like.

The image forming apparatus main body 10 is connected to a post-processing device 50. The post-processing device 50 includes a stapler 52 that staples a bundle of sheets in which the sheets exiting from the post-processing transport path 51 are bundled, and a sheet containing receiver 53 that is movable up and down and receives the stapled bundle of sheets.

Here, an image forming process in the image forming apparatus main body 10 is described.

In the photoconductor 14 of the image forming unit 13, a front surface thereof is charged by a charging device (not illustrated) and then is exposed by the exposure device 15 based on input image data, and an electrostatic latent image is formed. Meanwhile, toner is supplied to the developing device 16 from the toner supply bottle 19 and developer is agitated inside the developing device 16. The electrostatic latent image that is formed on the photoconductor 14 is developed with the toner inside the developing device 16, and a toner image is formed on the photoconductor 14. The formed toner image is transferred to a sheet at a transfer portion at which the transfer device 17 is brought into contact with the photoconductor 14, and the toner image is heated and fixed by the fixing device 18 so as to be output. Meanwhile, toner (residual toner) remaining on the photoconductor 14 after the transfer is removed and collected from the photoconductor 14 by the cleaning device 20.

Developing Device and Cleaning Device

Figure 3:
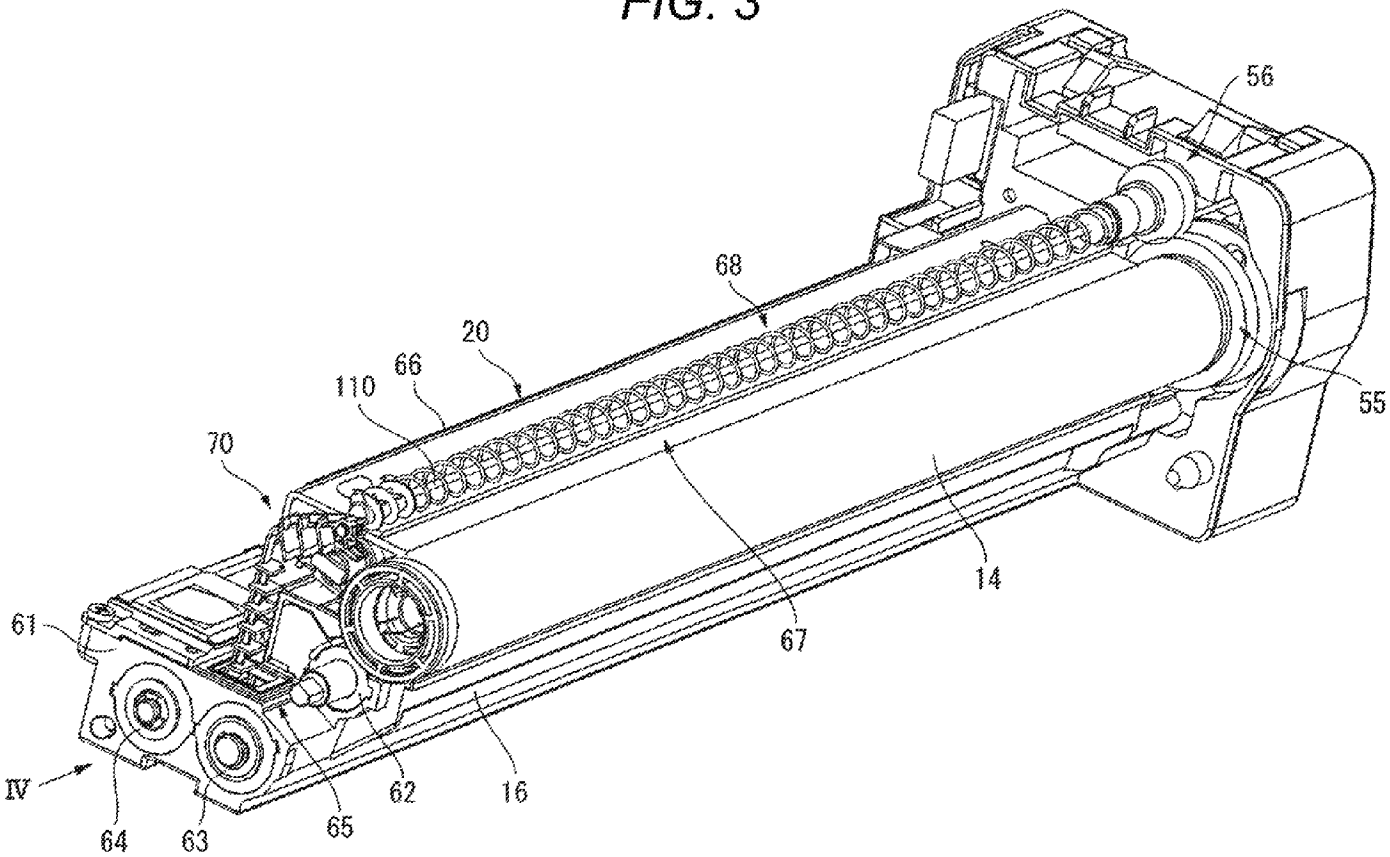
FIG. 3 is a view depicting a developing device, a cleaning device, and a toner returning mechanism as the powder transporting device of the image forming apparatus according to the first exemplary embodiment.

Further, in the exemplary embodiment, as illustrated in FIG. 3, the developing device 16 includes a developer container 61 which is provided below the cleaning device 20, which has an opened portion facing the photoconductor 14, and in which developer (for example, two-component developer containing toner and carrier) is contained. In the developing device, a developing roll 62, to which the developer is transported, is disposed in a position facing the opened portion of the developer container 61, and agitating-transport members 63 and 64 configured as a pair, in which the developer contained in the developer container 61 is agitated and transported, are disposed. Further, in the developing device, a new toner supply port (not illustrated), through which new toner from the toner supply bottle 19 can be supplied to the developer container 61, and a reusing-toner supply port 65 for reusing the toner collected by the cleaning device 20 are provided to be opened. Note that the reusing-toner supply port 65 is provided to be closer to the agitating-transport member 63 on a side close to the developing roll 62, and the new toner supply port is provided closer to the agitating-transport member 64 on a side far from the developing roll 62.

Meanwhile, as illustrated in FIG. 3, the cleaning device 20 has a cleaning container 66 which has an opened portion lacing the photoconductor 14 and in which the residual toner on the photoconductor 14 is contained. A cleaning blade 67, which scrapes and cleans the residual toner from the photoconductor 14, is disposed on an opening edge of the cleaning container 66, a toner transporting member 68, which extends in an axial direction of the photoconductor 14 and in which the residual toner contained in the cleaning container 66 is transported in the axis direction of the photoconductor 14, is disposed in the cleaning container 66, and a toner exit port 69 (refer to FIG. 4) is provided to be opened at the end of the cleaning container 66 downstream in a toner transporting direction by the toner transporting member 68.

Note that, in FIG. 3, reference number 55 represents a driver gear that drives the photoconductor 14, and reference number 56 represents a drive transmission gear that transmits a drive force from the drive gear 55 to the toner transporting member 68.

—Toner Returning Mechanism—

A toner returning mechanism 70 is provided between the toner exit port 69 of the cleaning device 20 and the reusing-toner supply port 65 of the developing device 16.

Figure 4:
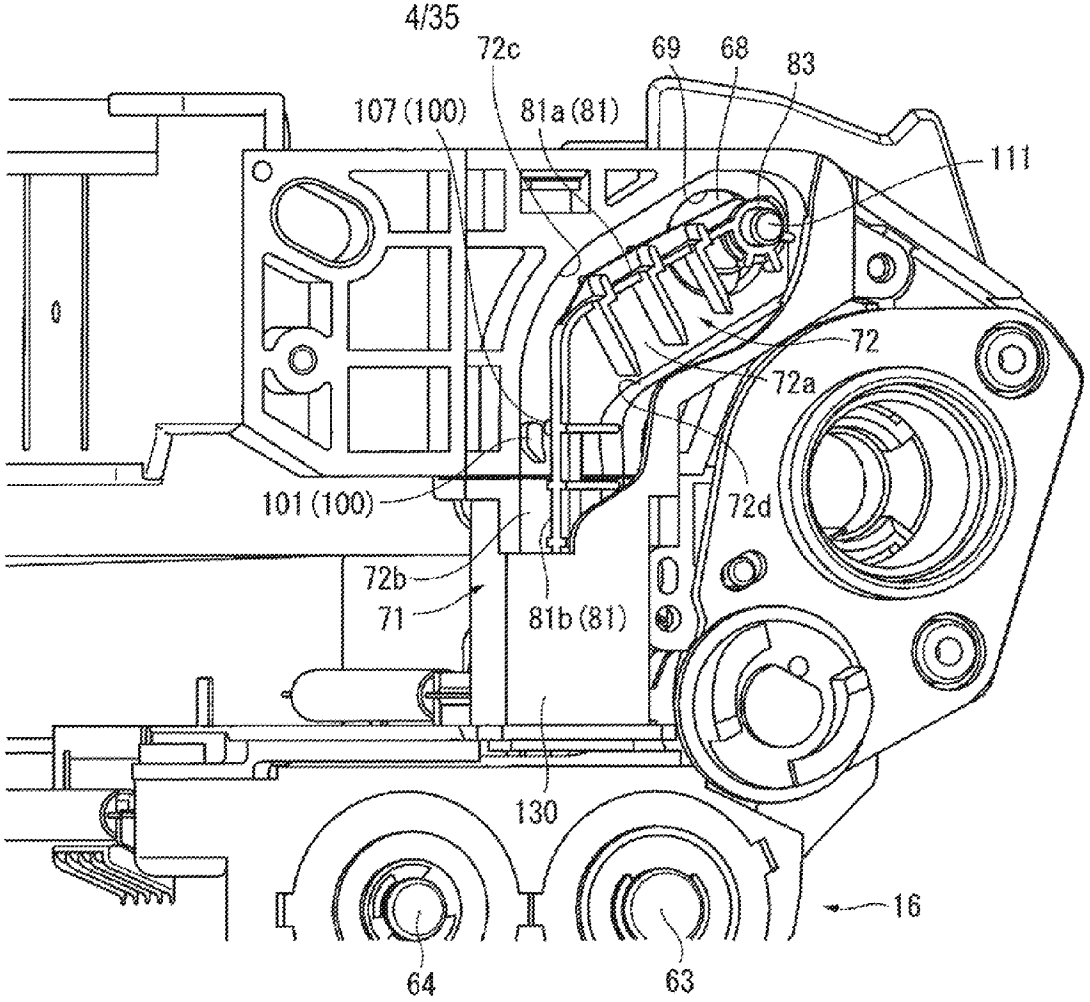
FIG. 4 is a perspective view illustrating main parts of the toner returning mechanism used in the present exemplary embodiment when viewed in direction IV in FIG. 3.
Figure 5:
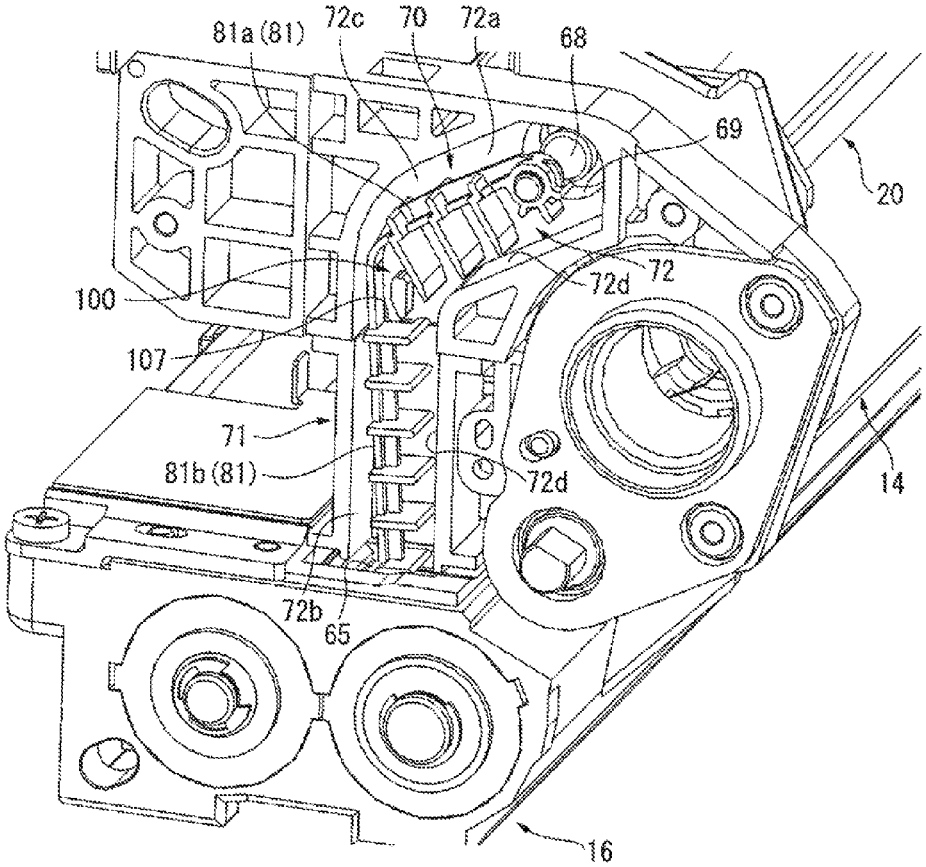
FIG. 5 is a perspective view illustrating a state in which a pressing cover is removed from the toner returning mechanism illustrated in FIG. 4.

As illustrated in FIGS. 3 to 5, in the toner returning mechanism 70, the toner exit port 69 of the cleaning device 20 and the reusing-toner supply port 65 of the developing device 16 communicate and are connected with each other through a duct member 71, a returning transport path 72 for transporting the toner collected in the cleaning device 20 to the developing device 16 is formed in the duct member 71, and a drive transport mechanism 80 (refer to FIG. 6) is disposed in the returning transport path 72.

Duct Member

In the example, as illustrated in FIGS. 4 and 5 and FIGS. 7 to 9B, the duct member 71 is configured to have a recess 122 formed in a sidewall 121 of a cartridge housing 120 for containing the photoconductor 14 and the cleaning device 20 in a cartridge, and a partition member 130 which has a cover portion 131 facing the recess 122 and has a vertical duct portion 132 extending in a substantially vertical direction toward the lower side of the cover portion 131.

Figure 9B:
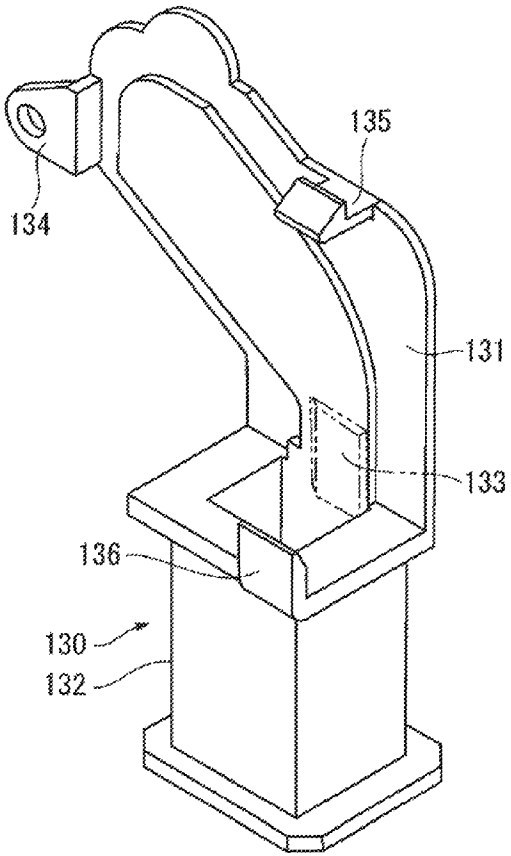
FIG. 9B is a perspective view of the pressing cover used in the pressing structure illustrated in FIG. 9A when viewed from an inner side.
Figure 9A:
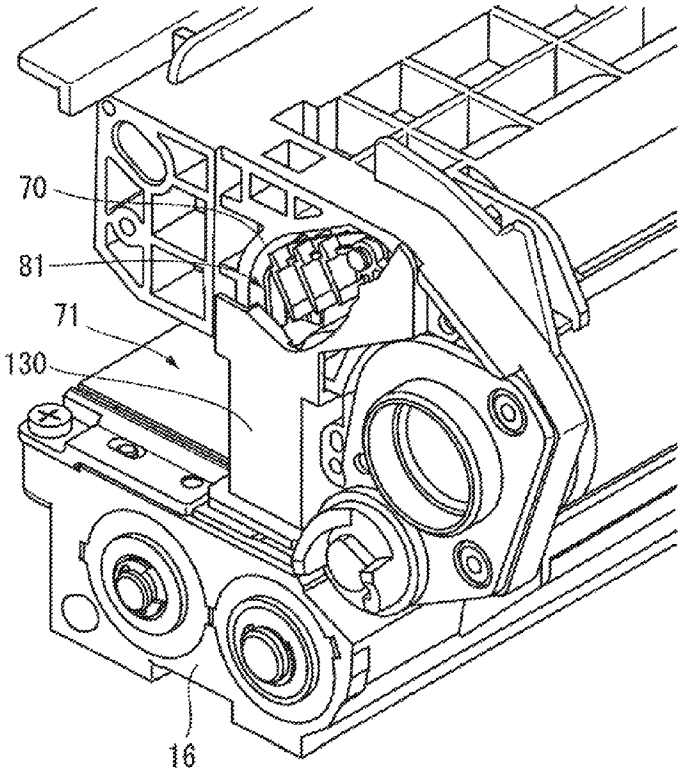
FIG. 9A is a view depicting a pressing structure in a state of engagement between the transport member and the regulation member used in the present exemplary embodiment.

Note that, in FIG. 9B, reference sign 134 represents an attachment piece that is attached to a stopper in the cartridge housing 120, and reference signs 135 and 136 represent positioning pieces that can be hooked into positioning holes (not illustrated) of the cartridge housing 120.

Returning Transport Path

In addition, the returning transport path 72 is described in detail. In the returning transport path 72, a lateral direction transport path 72*a*, which is inclined obliquely downward from a position of the toner exit port 69 of the cleaning device 20, communicates, via a smooth bent portion 72*c*, with a longitudinal-direction transport path 72*b* extending in a substantially vertical direction (longitudinal direction) from the reusing-toner supply port 65 of the developing device 16, and thus a bottom surface of the lateral direction transport path 72*a* and a side surface of the longitudinal-direction transport path 72*b*, which is continuous to the bottom surface, are used as a toner transport surface 72*d*.

Transport Member

In addition, the drive transport mechanism 80 has a transport member 81 that moves along the returning transport path 72. The transport member 81 is configured to have a lateral direction transport member 81*a* that reciprocates along the lateral direction transport path 72*a* of the returning transport path 72, and a longitudinal-direction transport member 81*b* that extends in the substantially vertical direction on the downstream side in the toner transporting direction of the lateral direction transport member 81*a*, is formed to be integral to the lateral direction transport member, and is disposed in the longitudinal-direction transport path 72*b*.

Here, a shape of the transport members 81 (lateral direction transport member 81*a* and longitudinal-direction transport member 81*b*) is described as follows.

First, the lateral direction transport member 81*a* is molded with a resin material such as POM, has a plate-shaped base member 82 extending in the toner transporting direction of the lateral direction transport path 72*a*, and is provided with an annular portion 83 as the drive input portion having a circular hole 84 at the end of the plate-shaped base member 82 on the upstream side in the toner transporting direction. Further, plural vane members 85 (in the example, $\mathbf{85}_1$ to $\mathbf{85}_3$) to the toner transport surface 72*d* of the lateral direction transport path 72*a* from the lower side of the plate-shaped base member 82 are arranged at a predetermined pitch and a recess 86 of a predetermined partitioned region is secured between the vane members 85.

In particular, in the present exemplary embodiment, the front end portion of the vane member 85 is configured of a sharp projection, and thus, is thrusted into the toner accumulated on the toner transport surface 72*d* with a weight of the lateral direction transport member 81*a* such that it is possible to improve a scraping effect of the toner.

In addition, in the lateral direction transport member 81*a*, plural (three in the example) assist vane members 87, which radially extend, are arranged around the annular portion 83 at appropriate intervals. Also, all or a part (in the example, $\mathbf{85}_1$ to $\mathbf{85}_3$) of the vane members 85 also protrude from the upper side of the plate-shaped base member 82 so as to be joined with, in an intersecting, manner, a guide rib 88 disposed to be orthogonal to the plate-shaped base member 82. Note that a notch 89 is formed on the backside of the vane member 85 (in the example, $\mathbf{85}_1$) positioned on the upstream side in the toner transporting direction, and thus, the backside of the vane member 85 is not backed.

In addition, the longitudinal-direction transport member 81*b* and the lateral direction transport member 81*a* are integrally molded to form an obtuse angle therebetween. The longitudinal-direction transport member 81*b* includes an elongated plate-shaped base member 91, which has a lower end portion extending to the reusing-toner supply port 65 of the developing device 16, and is provided with plural vane members 92 (in the example, $\mathbf{92}_1$ to $\mathbf{92}_6$) arranged on the side of the plate-shaped base member 91 at appropriate intervals so as to protrude from to the toner transport surface 72*d* side of the longitudinal-direction transport path 72*b*. Note that reference number 93 represents a reinforcement rib which is orthogonally disposed between the plate-shaped base member 91 and the vane members 92. In addition, a sharp projection may also be provided on the vane member 92, thereby making it possible to improve the scraping effect of the toner.

Drive Input Portion

Further, in the present exemplary embodiment, the annular portion 83 as the drive input portion of the lateral direction transport member 81*a* is attached to an end portion of a rotary shaft 110 of the toner transport member 68. This attachment causes an eccentric pin 111 to protrude at a position at which the eccentric pin is eccentrically positioned from the center of the rotary shaft 110 of the toner transport member 68, the eccentric pin 111 is fitted into the hole 84 of the annular portion 83 so as to play therein, and the annular portion 83 of the lateral direction transport member 81*a* is rotated via the eccentric pin 111 in a substantially circular track or in an flat elliptical track in the vertical direction. At this time, since the attachment position of the lateral direction transport member 81*a* with respect to the rotary shaft 110 of the toner transport member 68 of the cleaning device 20 is eccentric with respect to the rotary shaft 110 the annular portion 83 of the lateral direction transport member 81*a* is connected to the rotary shaft 110 of the toner transport member 68 in a so-called crank connection such that the transport members 81 (lateral direction transport member 81*a* and longitudinal-direction transport member 81*b*) performs reciprocating movement by a predetermined stroke.

Figure 6B:
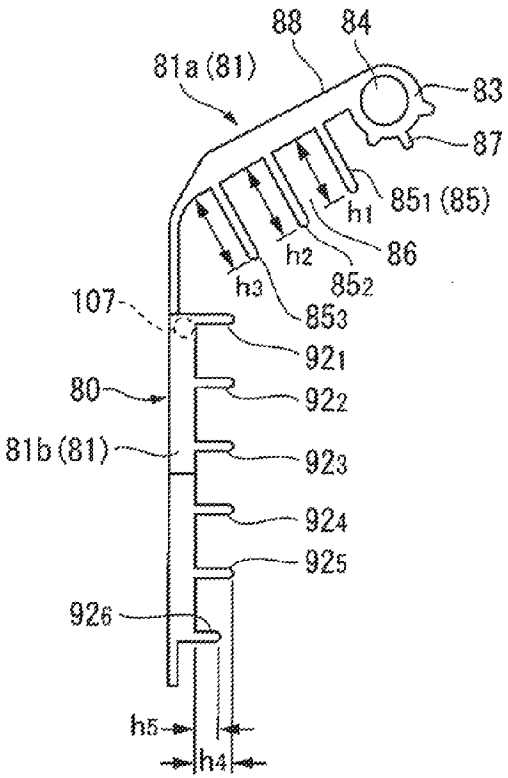
FIG. 6A is a perspective view illustrating an entire configuration of a transport member and FIG. 6B is a view depicting a dimensional relationship of the transport member.
Figure 6A:
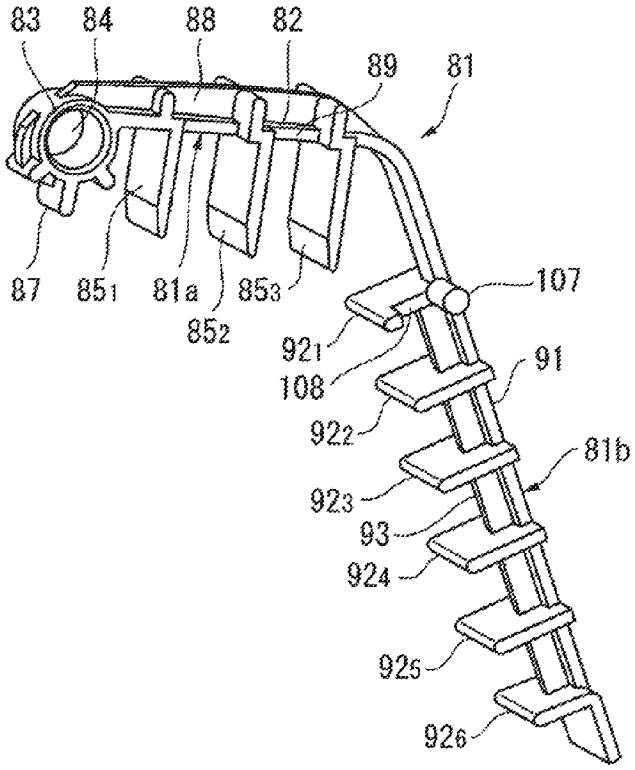

Furthermore, in the exemplary embodiment, dimensions of protrusion of the vane members 85 and 92 of the transport member 81 are set as follows. (1) Vane members 85 of lateral direction transport member 81*a:* as illustrated in FIG. 6B, in a case where dimensions of protrusion of the vane members 85 ($\mathbf{85}_1$ to $\mathbf{85}_3$) are $h_1$ to $h_3$, the dimension of protrusion of the vane member of the vane members 85 ($\mathbf{85}_1$ to $\mathbf{85}_3$), which is positioned on the upstream side in the toner transporting direction, is set to be longer than the vane member on the upstream side. In other words, a relationship of $h_1<h_2<h_3$ is satisfied, (2) Vane members 92 of longitudinal-direction transport member 81*b:* as illustrated in FIG. 6B, in a case where the dimension of protrusion of the vane members 92 ($\mathbf{92}_1$ to $\mathbf{92}_5$) are $h_4$ and the dimension of protrusion of the vane members 92 ($\mathbf{92}_6$) is $h_5$, a relationship of $h_5<h_4$ is satisfied.

Guide Mechanism

Further, in the exemplary embodiment, the transport members 81 reciprocally moves in the returning transport path 72 in response to the rotational motion of the annular portion 83 as the drive input portion, and a guide mechanism 100 for regulating the transport behavior of toner by transport members 81 is provided.

Figure 7:
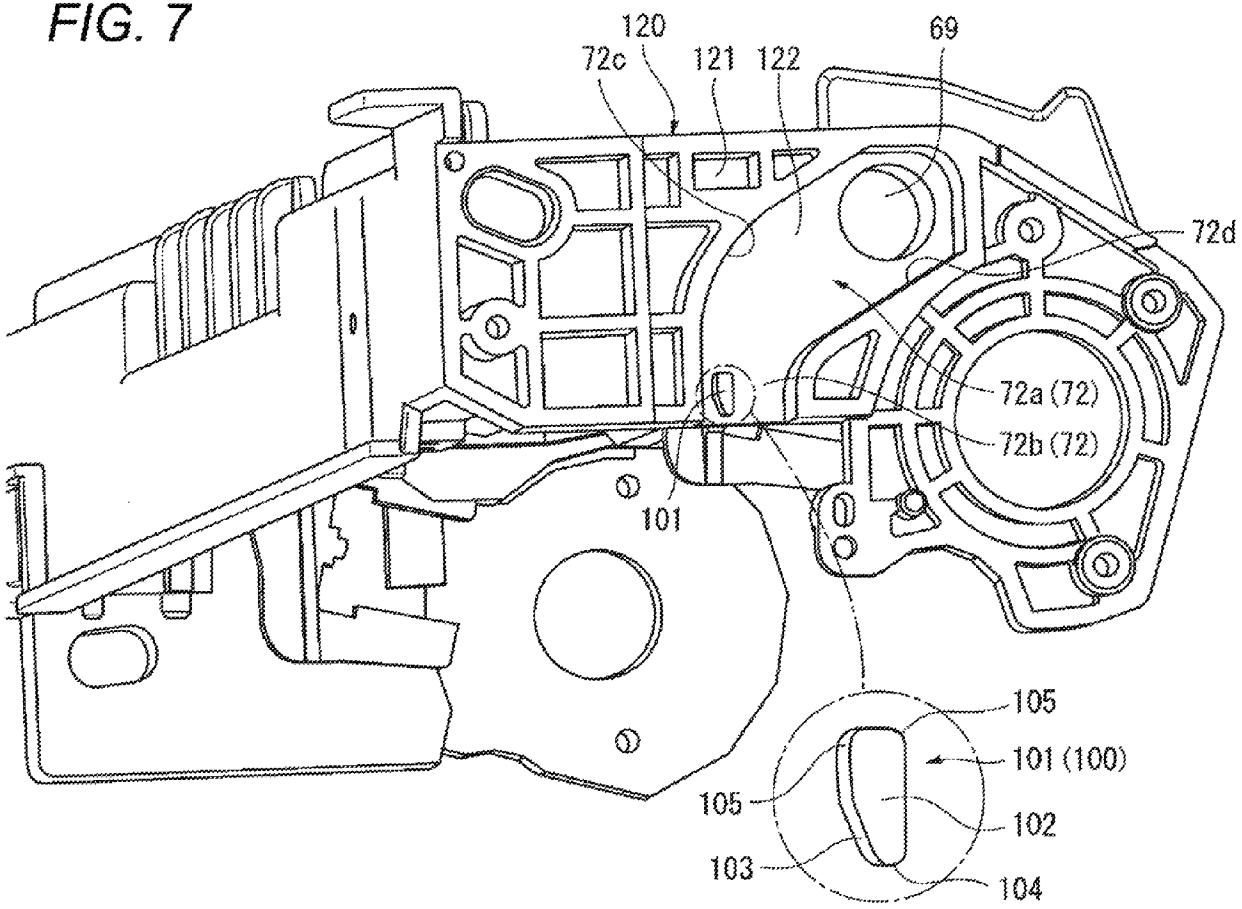
FIG. 7 is a view depicting an example of disposition of a regulation member used in the present exemplary embodiment.
Figure 8:
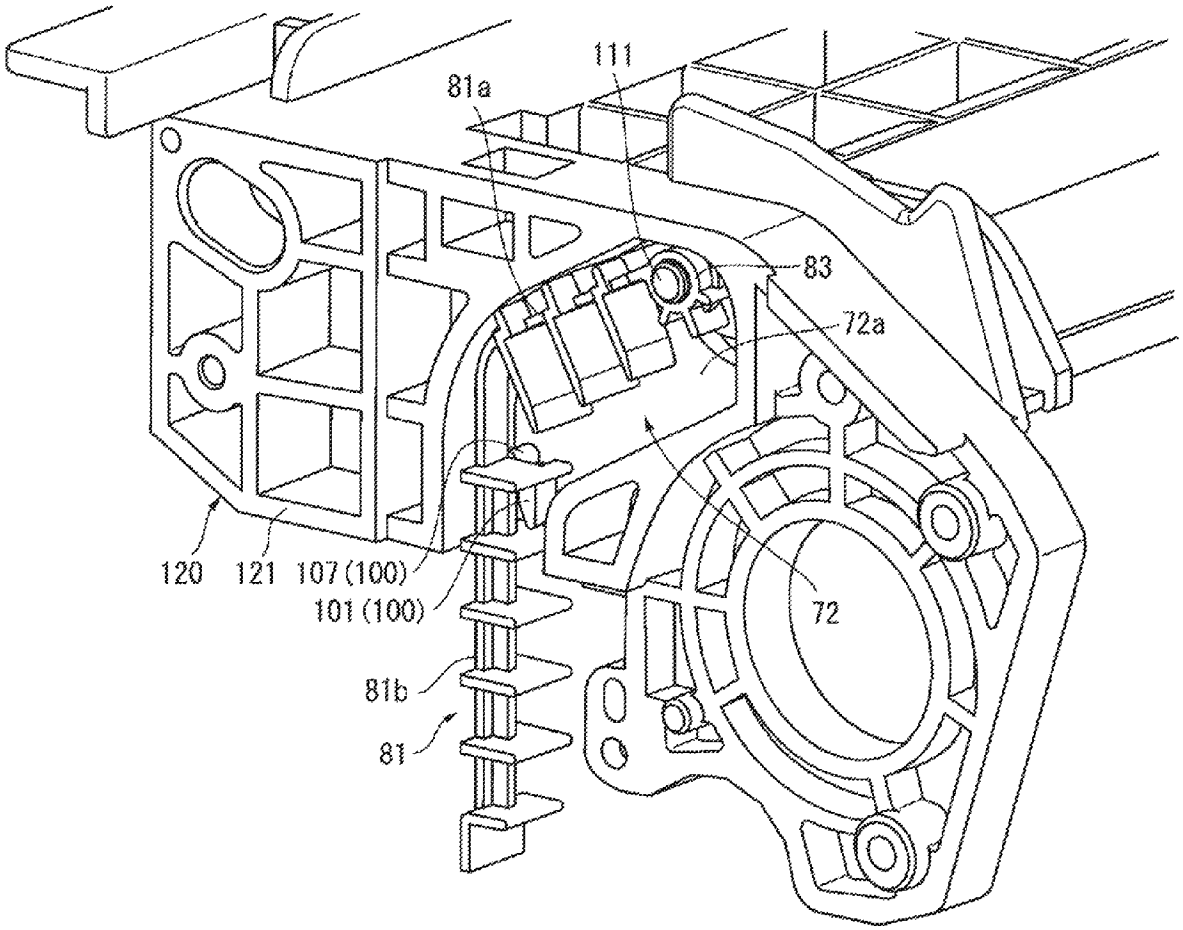
FIG. 8 is a view depicting a dispositional relationship between the transport member and the regulation member used in the present exemplary embodiment.

In the example, as illustrated in FIGS. 5, 7, and 8, in the guide mechanism 100, a guide protrusion 101 is formed in a bottom of the recess 122 of the cartridge housing 120 of the duct member 71 that partitions the longitudinal-direction transport path 72*b* so as to protrude from the bottom in the upper half region of the longitudinal-direction transport path 72*b*, and a guide pin 107, which protrudes toward the bottom of the recess 122, is formed in a connection portion between the plate-shaped base member 91 and the vane member $\mathbf{92}_1$ positioned on the uppermost end of the longitudinal-direction transport member 81*b*. The guide protrusion 101 engages with the guide pin 107, whereby the guide pin 107 moves around the guide protrusion 101. In this manner, the behavior of the portion of the guide pin 107 of the longitudinal-direction transport member 81*b* is regulated, whereby the behavior of the transport members 81 (lateral direction transport member 81*a* and longitudinal-direction transport member 81*b*) is regulated.

In the example, as illustrated particularly in FIG. 8, the guide protrusion 101 has a rod-shaped convex portion 102 having a substantially rectangular shaped cross section, which extends in the longitudinal direction in the vertical direction, an inclined portion 103 is formed to be narrowed toward the lower side on a side in the lower side portion of the rod-shaped convex portion 102, which is separated from the drive input portion of the lateral direction transport member 81*a*, and the lower end portion of the rod-shaped convex portion 102 is formed as a curved portion 104. Note that an upper corner of the rod-shaped convex portion 102 is also formed as the curved portion (or corner having an obtuse angle) 105.

Meanwhile, the guide pin 107 has a circular columnar shape and a circumferential surface of the guide pin 107 moves around the guide protrusion 101 while the circumferential surface of the guide pin comes into contact with the periphery of the guide protrusion 101. In addition, when the guide pin 107 engages with the guide protrusion 101, the vane member $\mathbf{92}_1$, on which the guide pin 107 is formed, has a notch 108 so as to avoid interfering with the guide protrusion 101.

In particular, in the example, since the corners of the guide protrusion 101 has the curved portions 104 and 105, the contact resistance between the guide pin 107 and the corner of the guide protrusion 101 is decreased, and the guide protrusion 101 has the inclined portion 103 from the lower end portion such that the guide pin 107 is guided upward along the inclined portion 103 after passing through the lower end portion of the guide protrusion 101.

The guide mechanism 100 having such a structure allows the vane members 85 ($\mathbf{85}_1$ to $\mathbf{85}_3$) to come into contact with the toner transport surface 72*d* of the longitudinal-direction transport path 72*a* during the forward movement of the lateral direction transport member 81*a,* and, further, regulates the behavior of the transport members 81 such that the transport members 81 (lateral direction transport member 81*a* and longitudinal-direction transport member 81*b*) are disposed to be separated from the toner transport surface 72*d* of the returning transport path 72 during the backward movement of the lateral direction transport member 81*a*.

Operation of Toner Returning Mechanism

Figures 18A, 18B, 18C, 18D:
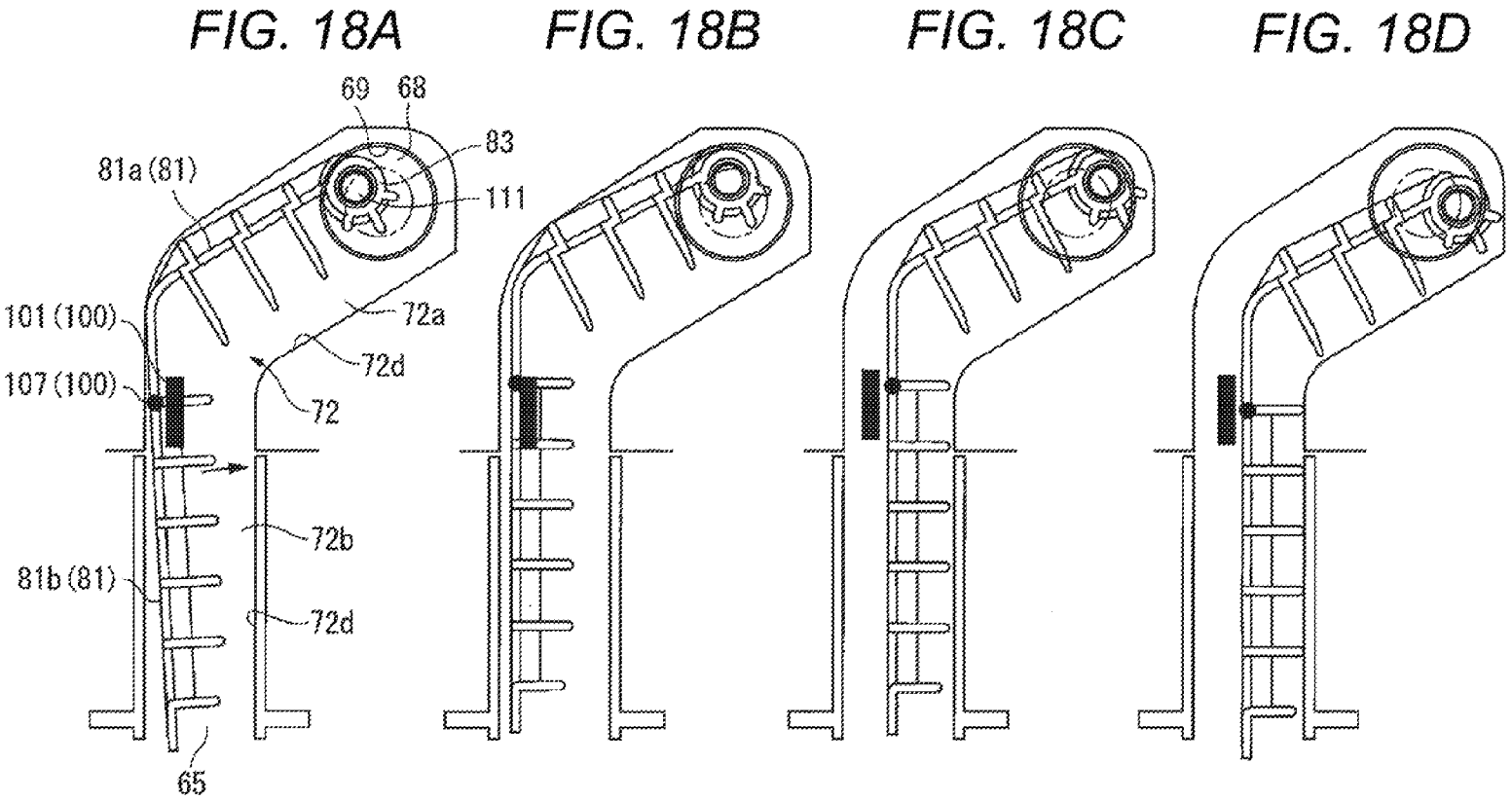
FIGS. 18A to 18D are views depicting a positional change (3) of the regulation member and the regulation-target portion in the operation process of the transport member used in the first exemplary embodiment.

Next, an operation of the toner returning mechanism 70 will be described. Here, FIGS. 10 to 15 illustrate motions of the toner returning mechanism 70 in order stepwisely, and FIGS. 16 to 18 schematically illustrate particularly changes in the operation of the guide mechanism 100 of the toner returning mechanism 70. Note that, in FIGS. 16 to 18, the shape of the guide protrusion 101 of the guide mechanism is schematically described as a rod-shaped rectangular shape.

Figure 10:
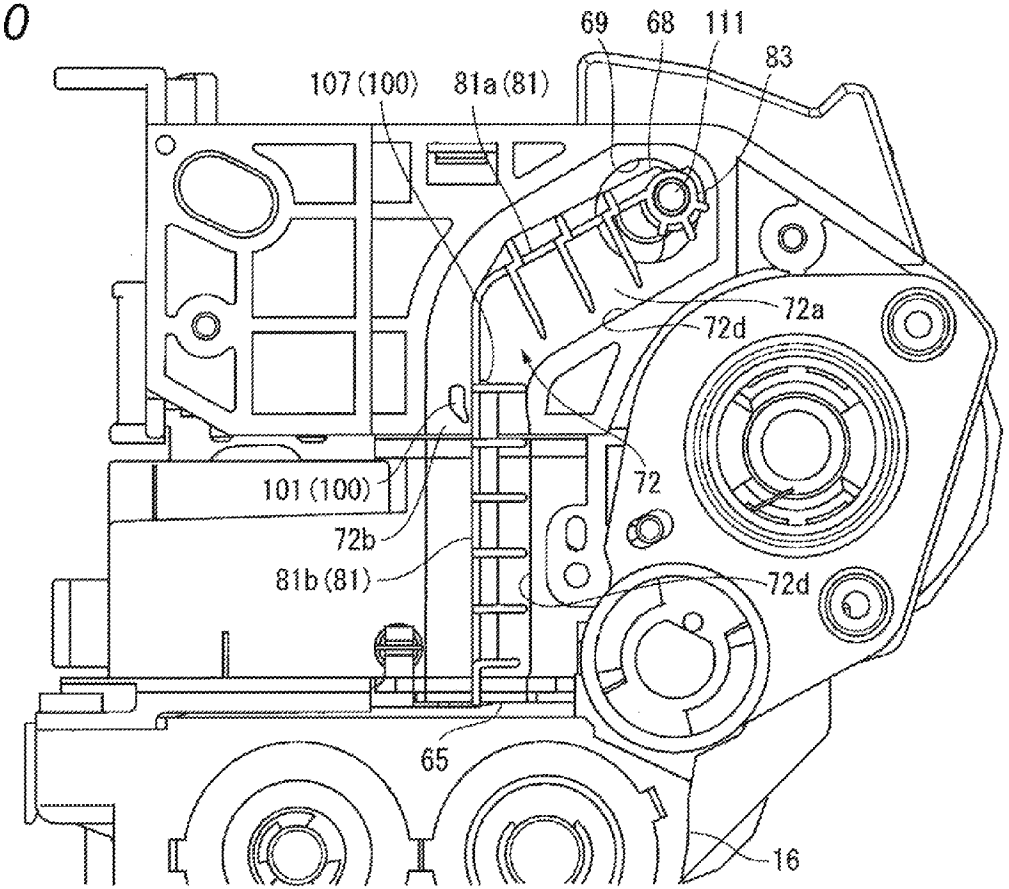
FIG. 10 is a view depicting an operation process (1) of the transport member used in the present exemplary embodiment.

Here, it is assumed that the toner transport member 68 in the cleaning device 20 rotates and the annular portion 83 as the drive input portion is positioned as illustrated in FIG. 10.

At this time, in the guide mechanism 100, the guide pin 107 of the transport members 81 is not in contact with the guide protrusion 101, but the vane members 92 ($\mathbf{92}_1$ to $\mathbf{92}_5$) of the longitudinal-direction transport member 81*b* are disposed to be in contact with the toner transport surface 72*d* of the longitudinal-direction transport path 72*b*. Therefore, in this manner, the lateral direction transport member 81*a* is disposed to be separated from the toner transport surface 72*d* of the lateral direction transport path 72*a*.

In this state, a large amount of toner exits from the toner exit port 69 of the cleaning device 20, and there is no backed portion by a shape of the notch 89 even when the large amount of toner exits onto the lateral direction transport member 81*a*. Therefore, it is effective to avoid a jammed state of the toner between the lateral direction transport member 81*a* and the lateral direction transport path 72*a*.

Figure 11:
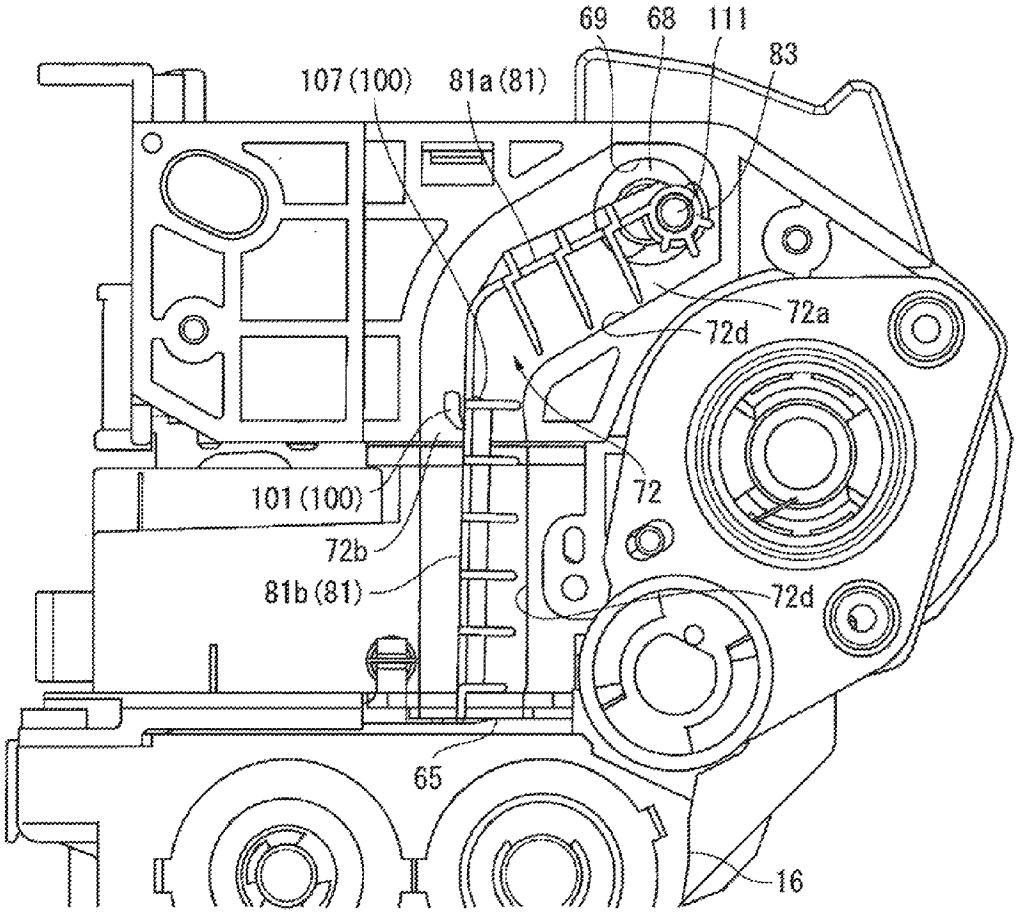
FIG. 11 is a view depicting an operation process (2) of the transport member used in the present exemplary embodiment.

Then, when the toner transport member 68 rotates and the eccentric pin 111, which is eccentrically positioned from the center of the rotary shaft 110, moves to a position illustrated in FIG. 11, the position of the annular portion 83 of the lateral direction transport member 81*a* is lowered in response to the motion of the eccentric pin 111, and thus, in this manner, the lateral direction transport member 81*a* moves downward.

At this time, the vane member $\mathbf{85}_3$ positioned on the most downstream side of the vane members 85 of the lateral direction transport member 81*a* comes into contact with the toner transport surface 72*d* of the lateral direction transport path 72*a* in response to movement of the lateral direction transport member 81*a*.

Meanwhile, the vane member 92 of the longitudinal-direction transport member 81*b* without including a part (in the example, $\mathbf{92}_1$) starts to be separated from the toner transport surface 72*d* of the longitudinal-direction transport path 72*b*. In particular, since the dimension of the protrusion of the vane member 85 of the lateral direction transport member 81*a* is set to be longer in order toward the downstream side, a posture of the inclination of the lateral direction transport member 81*a* is slightly lifted in a case the vane member 85 is disposed to be in contact with the toner transport surface 72*d*, and in this manner, the vane member 92 of the longitudinal-direction transport member 81*b* maintains a state of being separated from the toner transport surface 72*d* of the longitudinal-direction transport path 72*b*. Therefore, when the toner transported to the lateral direction transport member 81*a* reaches the longitudinal-direction transport path 72*b* from the lateral direction transport path 72*a*, the toner moves downward through a secured transport space without interference with the toner which performs natural dropping along the toner transport surface 72*d* of the longitudinal-direction transport path 72*b*.

In this state, the guide pin 107 of the transport members 81 moves, but, does not reach the guide protrusion 101.

Figure 12:
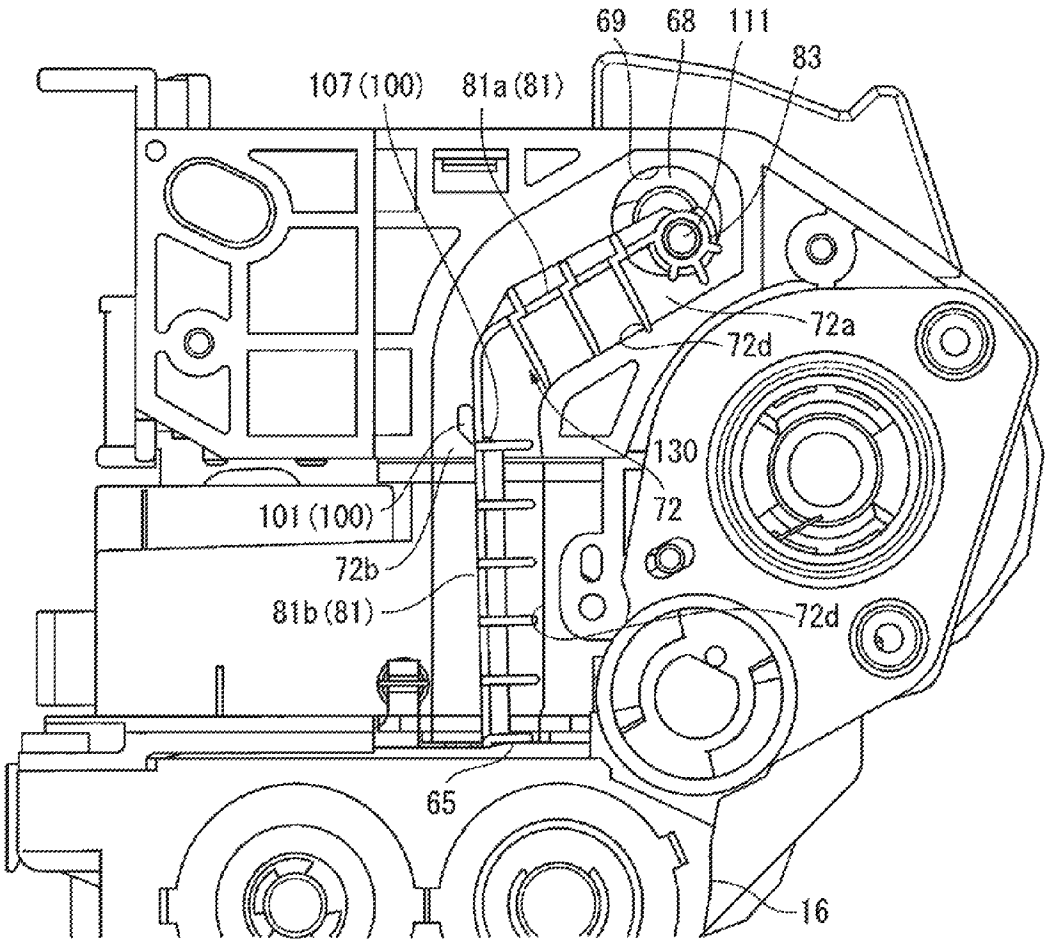
FIG. 12 is a view depicting an operation process (3) of the transport member used in the present exemplary embodiment.

Then, when the eccentric pin 111 further rotates and reaches a position illustrated in FIG. 12, all of the vane members 85 ($\mathbf{85}_1$ to $\mathbf{85}_3$) of the lateral direction transport member 81*a* come into contact with the toner transport surface 72*d* of the lateral direction transport path 72*a* and straightly moves downward along the toner transport surface 72*d*. Therefore, the lateral direction transport member 81*a* coveys downward the toner on the toner transport surface 72*d* and causes the toner to drop from the longitudinal-direction transport path 72*b*.

In particular, in the present exemplary embodiment, since the toner collected in the cleaning device 20 is transported to the developing device 16 in order of respective volumes of the recesses 86 of the lateral direction transport member 81*a*, it is possible to reduce variations in an amount of supply to the developing device 16.

Further, the longitudinal-direction transport member 81*b* coupled with the lateral direction transport member 81*a* in the downward movement moves downward, and, in this manner, the vane member 92 of the longitudinal-direction transport member 81*b* moves downward straightly along the toner transport surface 72*d*. Therefore, even when the toner is attached on the toner transport surface 72*d* of the longitudinal-direction transport path 72*b*, the toner is effectively scraped by the longitudinal-direction transport member 81*b*.

In addition, since, in response to the rotating, movement of the eccentric pin 111, the assist vane member 87 of the lateral direction transport member 81*a* comes into contact with and moves along an inner wall surface on the upstream side of the lateral direction transport path 72*a*, the toner attached on the inner wall on the upstream side of the lateral direction transport path 72*a* is effectively scraped.

Figure 13:
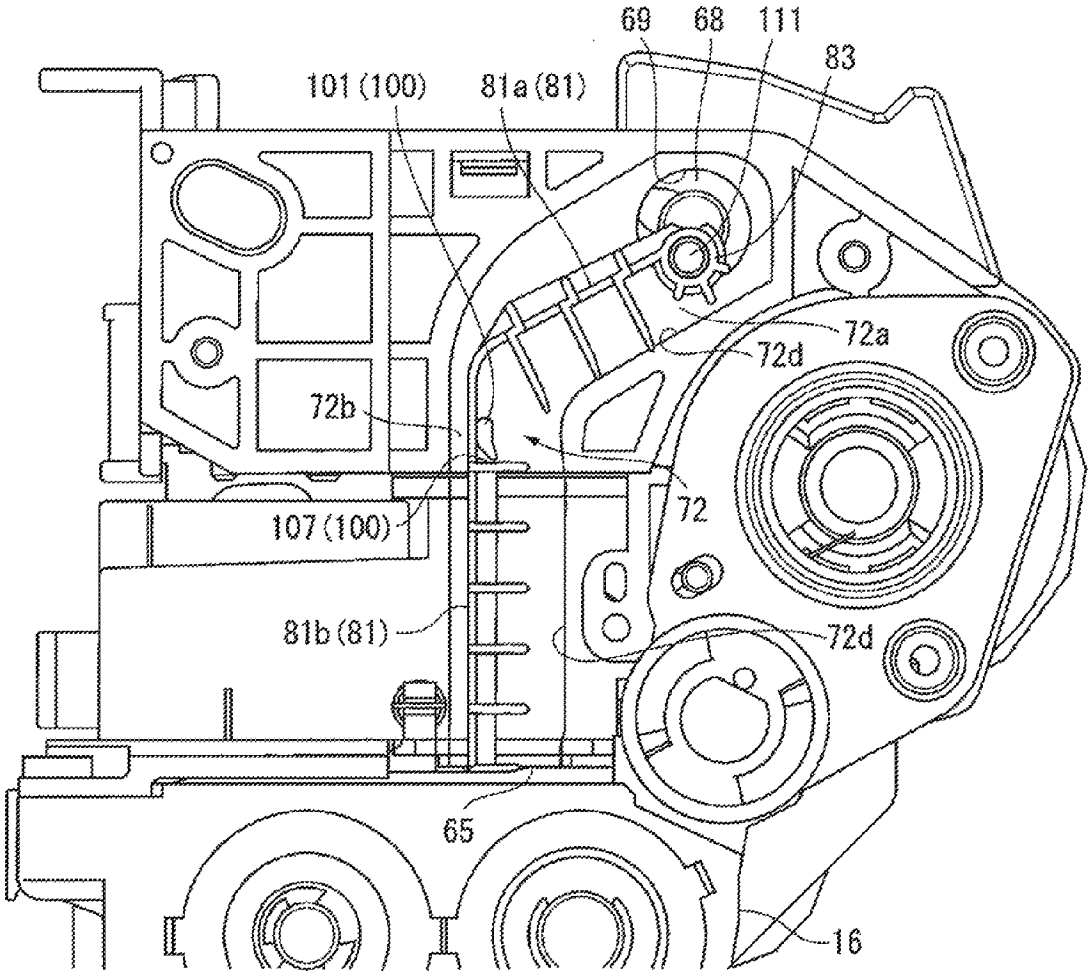
FIG. 13 is a view depicting an operation process (4) of the transport member used in the exemplary embodiment.

Further, when the eccentric pin 111 rotates to a position illustrated in FIG. 13, the vane members 85 of the lateral direction transport member 81*a* move straightly along the toner transport surface 72*d* and, as a result, the vane member $\mathbf{85}_3$, which is positioned on the most downstream side of the vane members 85 of the lateral direction transport member 81*a* comes out from the toner transport surface 72*d* of the lateral direction transport path 72*a*, and reaches an upper space of the longitudinal-direction transport path 72*b*.

Then, the transport members 81 tilts with the vane member $\mathbf{85}_2$ as a fulcrum by a weight balance and the longitudinal-direction transport member 81*b* moves like a pendulum and abuts on the toner transport surface 72*d* side of the longitudinal-direction transport path 72*b*. At this time, the second vane member 92 ($\mathbf{92}_5$) from the bottom of the longitudinal-direction transport member 81*b* comes into contact with the toner transport surface 72*d* of the longitudinal-direction transport path 72*b* and the posture of the longitudinal-direction transport member 81*b* is regulated.

In this state, in the guide mechanism 100, as illustrated in FIG. 13, the guide pin 107 of the transport member 81 just passes below the lower end portion of the guide protrusion 101 and moves to a region on the backside of the side opposite to the lateral direction transport member 81*a* of the guide protrusion 101. However, when the longitudinal-direction transport member 81*b* moves like a pendulum, the guide pin 107 is not regulated by the guide protrusion 101 (refer to FIG. 17A).

Figure 14:
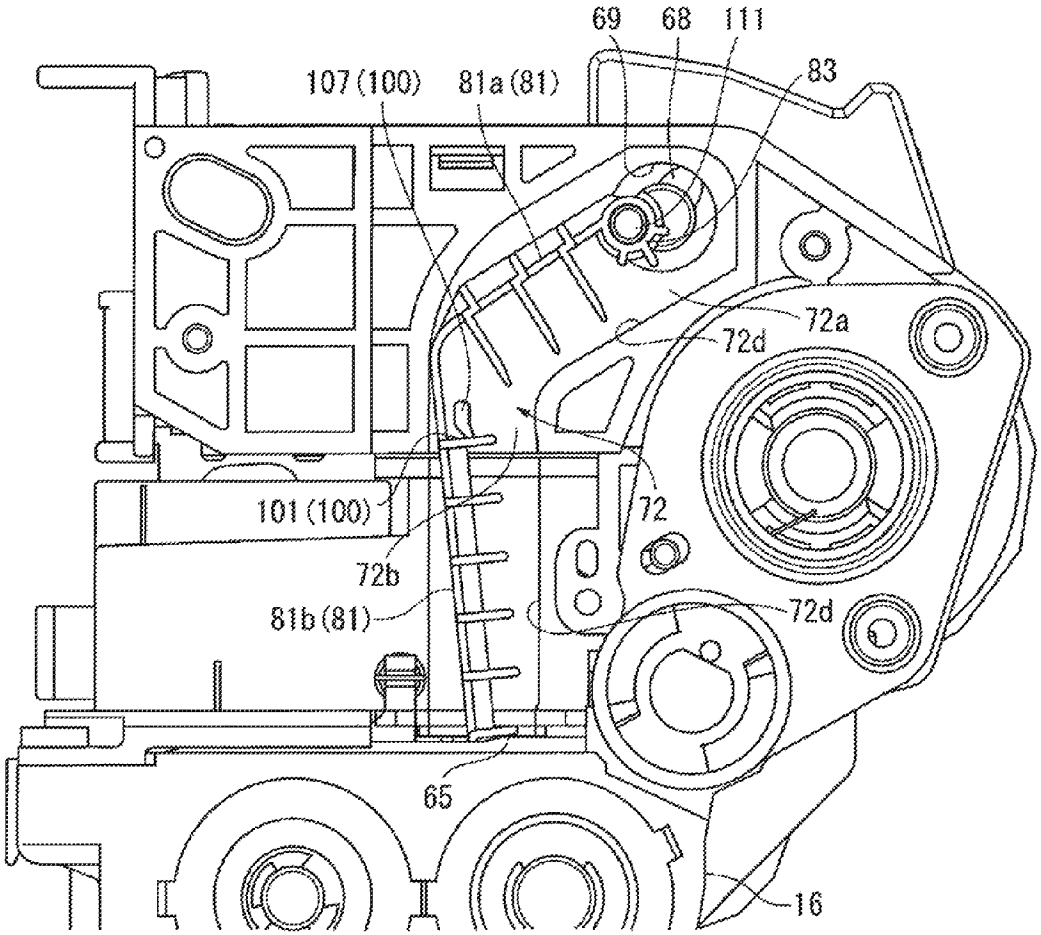
FIG. 14 is a view depicting an operation process (5) of the transport member used in the present exemplary embodiment.

Then, when the eccentric pin 111 rotates to a position illustrated in FIG. 14, in this manner, the lateral direction transport member 81*a* moves upward and the longitudinal-direction transport member 81*b* is lifted in a coupled motion with the lateral direction transport member 81*a*. At this time, without the guide mechanism 100, in the longitudinal-direction transport member 81*b*, the vane member 92 (for example, $\mathbf{92}_5$) positioned on the lower side comes into contact with the toner transport surface 72*d* and there may be a concern that the upward movement of the longitudinal-direction transport member 81*b* will be interrupted.

However, in the present exemplary embodiment, the guide pin 107 of the guide mechanism 100 is lifted while being in contact with the backside of the guide protrusion 101, and thus, an unnecessary contact motion of the vane member 92 with the toner transport surface 72*d* of the longitudinal-direction transport path 72 due to dropping of the longitudinal-direction transport member 81*b* is avoided.

In addition, in this state, as illustrated in FIG. 14, since the dimension h5 of the protrusion of the vane member $\mathbf{92}_6$ positioned on the lowermost end of the longitudinal-direction transport member 81*b* is set to be shorter than the dimension h4 of the protrusion of the other vane members 92 ($\mathbf{92}_1$ to $\mathbf{92}_5$), the vicinity of the lower end portion (including the vane member $\mathbf{92}_6$) of the longitudinal-direction transport member 81*b* is disposed in a region immediately below an opening at the lower end of the longitudinal-direction transport path 72*b*, even when the lower end portion of the longitudinal-direction transport member 81*b* protrudes below the opening of the lower end of the longitudinal-direction transport path 72*b*. Therefore, even when the longitudinal-direction transport member 81*b* is lifted and the lower end portion of the longitudinal-direction transport member 81*b* is lifted in the longitudinal-direction transport path 72*b*, there is no concern that the vane member $\mathbf{92}_6$ will be hooked by the opening edge (specifically, an opening edge of the lower end of the duct member 71) of the lower end of the longitudinal-direction transport path 72*b*.

Figure 15:
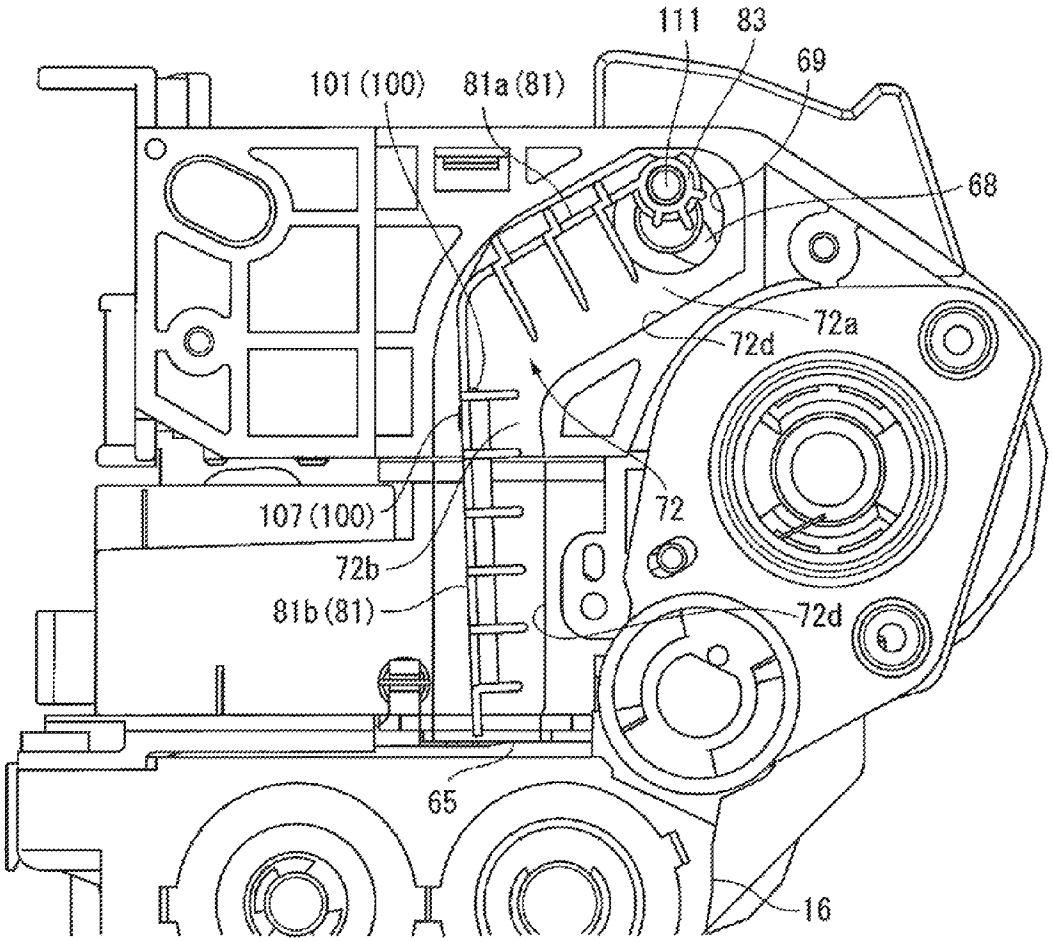
FIG. 15 is a view depicting an operation process (6) of the transport member used in the present exemplary embodiment.
Figures 16A, 16B, 16C, 16D:
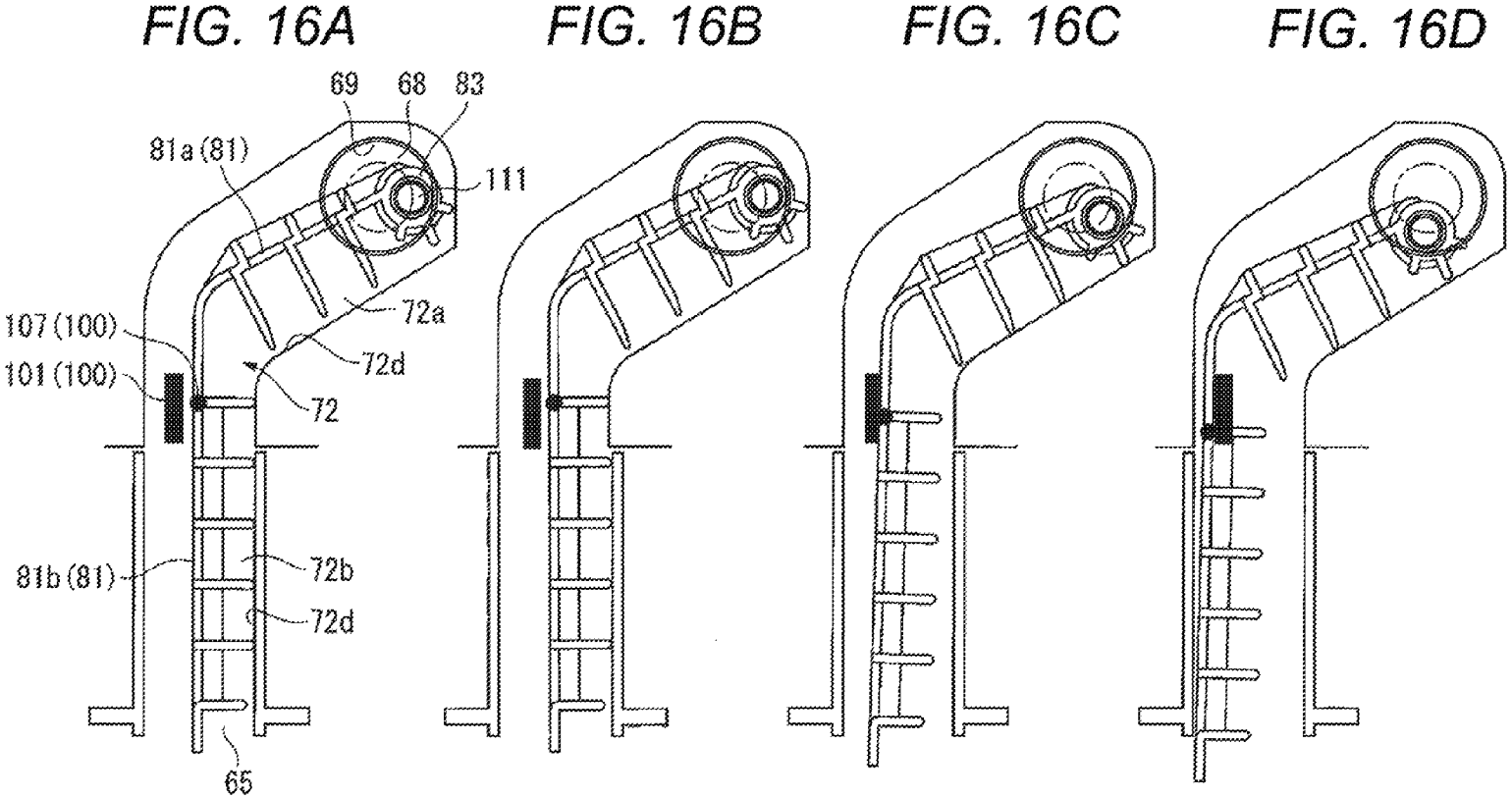
FIGS. 16A to 16D are views depicting a positional change (1) of the regulation member and a regulation-target portion in the operation process of the transport member used in the first exemplary embodiment.
Figure 17A:
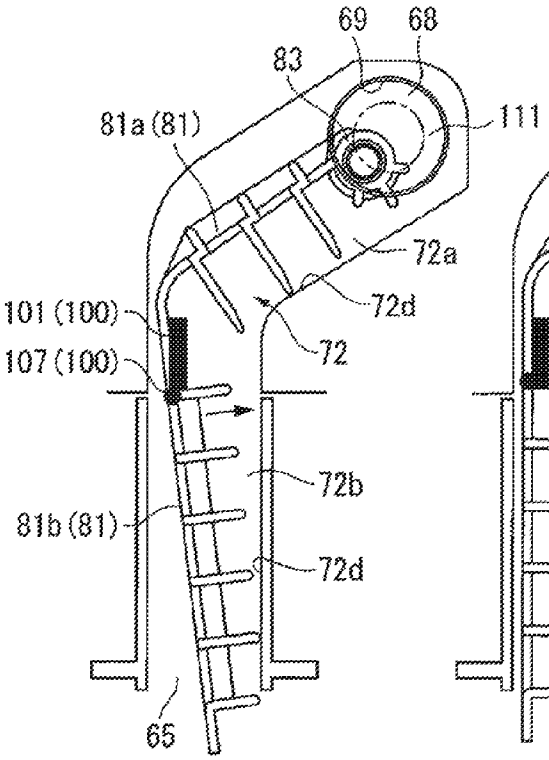
FIGS. 17A to 17D are views depicting a positional change (2) of the regulation member and the regulation-target portion in the operation process of the transport member used in the first exemplary embodiment.
Figure 17B:
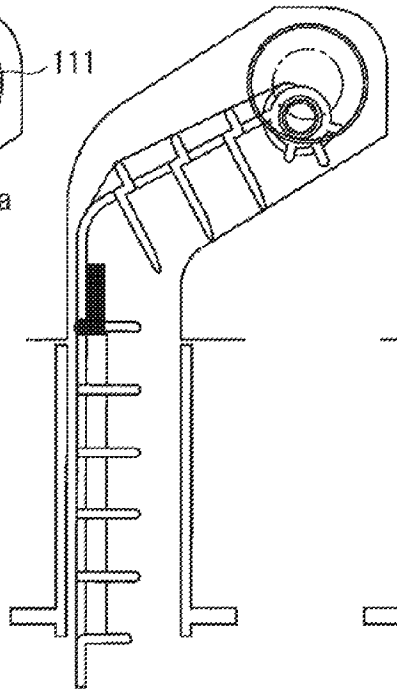
Figure 17C:
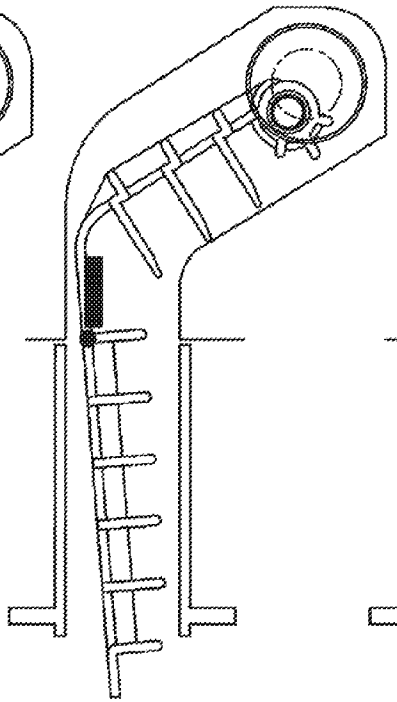
Figure 17D:
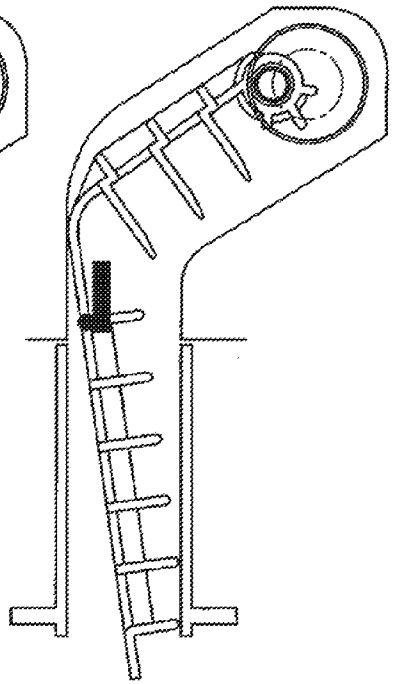

Further, when the eccentric pin 111 rotates to the position illustrated in FIGS. 14 and 15, the guide pin 107 of the guide mechanism 100 is lifted while engaging with a back side of the guide protrusion 101, and reaches the upper edge of the guide protrusion 101.

In this state, the lateral direction transport member 81*a* of the transport member 81 moves backward while maintaining a non-contact state of the vane member 85 with respect to the toner transport surface 72*d* of the lateral direction transport path 72*a*. In addition, in the guide mechanism 100, the behavior of the longitudinal-direction transport member 81*b* is regulated, and thus there is no concern that the posture of the longitudinal-direction transport member 81*b* will fall, the lateral direction transport member 81*a* will be lowered by the falling of the longitudinal-direction transport member 81*b* such that the vane member 85 comes into contact the toner transport surface 72*d* of the lateral direction transport path 72*a*, and the toner on the toner transport surface 72*d* will be transported obliquely upward in a reverse flow direction.

Then, when the eccentric pin 111 further rotates and again reaches a position illustrated in FIG. 10, the transport member 81 is adjusted to a predetermined position and then, the operation processes illustrated in FIGS. 10 to 15 are repeated.

In the operation processes, in the guide mechanism 100, the guide pin 107 moves while engaging with the guide protrusion 101 as illustrated in FIGS. 16 to 18, and the behavior of the transport members 81 is regulated.

In this manner, since the behavior of the transport member 81 is regulated by the guide mechanism 100, the following operations are achieved.

In other words, since the lateral direction transport member 81*a* performs straight motion in the toner transporting direction, and does not perform motion along the toner transport surface 72*d* in a reverse toner transporting direction, transportability of the toner is sufficiently maintained in the lateral direction transport path 72*a*.

In addition, the longitudinal-direction transport member 81*b* can also perform a contact operation with respect to the toner transport surface 72*d* of the longitudinal-direction transport path 72*b*, moves straightly when coming into contact with the toner transport surface 72*d*, and can be separated from the toner transport surface 72*d* during the transport operation of the toner by the lateral direction transport member 81*a*. Therefore, the toner attached on the toner transport surface 72*d* is effectively scraped, and there is no interference with the natural falling of the toner from the lateral direction transport path 72*a* to the longitudinal-direction transport path 72*b*. Accordingly, the transportability of the toner in the longitudinal-direction transport path 72*b* is sufficiently maintained.

In this manner, in the present exemplary embodiment, the transportability of the toner is sufficiently maintained in any of the lateral direction transport path 72*a* and the longitudinal-direction transport path 72*b*.

Modification Exemplary Embodiment

In the present exemplary embodiment, the forced transportation is performed on the upstream side of the returning transport path 72, and transport is performed with the natural dropping on the downstream side; however, the forced transportation may be performed on the entirety of the returning transport path 72 having a bent portion in an immediate portion thereof.

In addition, in the present exemplary embodiment, the returning transport path 72, the transport members 81, or the like are provided only on the end side of the photoconductor 14 in the axial direction; however, it is possible to provide the path or the members at both end portions in a case of a configuration in which toner is collected on both sides in the axial direction by the toner transport member 68.

Further, in exemplary embodiment, the transport members 81 are configured to move straightly in the returning transport path 72 during forward movement; however, it is possible for the members to be configured to perform transportation by transport movement, for example, flat elliptical movement, or the like. In addition, as a driving source of the transport member 81, a drive system of the toner transport member 68 is used; however, a separate driving source may be provided.

First Comparative Example

Figure 19:
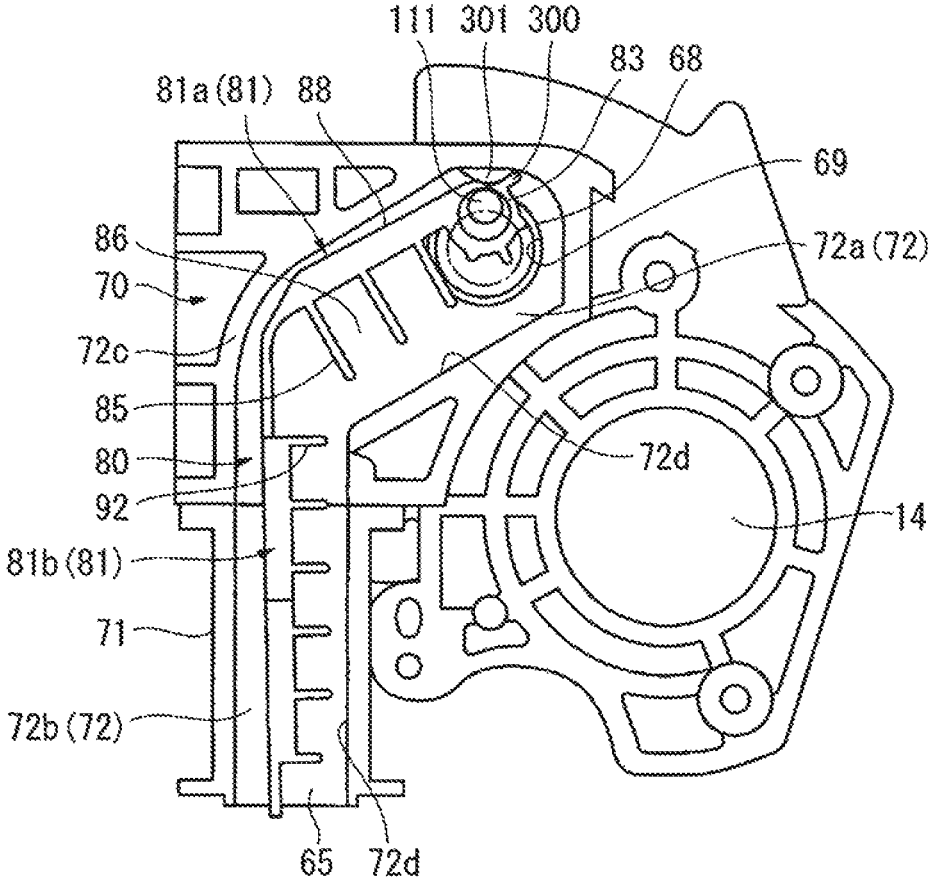
FIG. 19 is a view depicting an example of a toner returning mechanism used in a first comparative embodiment.

FIG. 19 illustrates main parts of e toner returning mechanism 70 according to a first comparative embodiment.

In FIG. 19, unlike the first exemplary embodiment, the toner returning mechanism 70 is provided with a guide mechanism 300 between the lateral direction transport path 72*a* and the vicinity of the drive input portion of the lateral direction transport member 81*a*. Note that the same reference signs as in the first exemplary embodiment are assigned to the same components as in the first exemplary embodiment, and description thereof is omitted.

In the exemplary embodiment, the guide mechanism 300 has a guide protrusion 301 protruding with an arc-shaped cross section on an upper surface positioned on the upstream in the toner transporting direction of the lateral direction transport path 72*a*, and is provided with a guide protruding piece 302 in a portion of the annular portion 83 as the drive input portion of the lateral direction transport member 81*a*. The guide protruding piece 302 engages with the guide protrusion 301 such that the behavior of the lateral direction transport member 81*a* is regulated.

In the comparative embodiment, the guide protrusion 301 as the guide mechanism 300 engages with the guide projecting piece 302, whereby the behavior (posture) of the lateral direction transport member 81*a* is regulated, and the lateral direction transport member 81*a* and the longitudinal-direction transport member 81*b* are disposed to be separated from the toner transport surface 72*d* of the returning transport path 72 during the backward movement of the transport members 81.

However, in the comparative embodiment, since the guide mechanism 300 is provided in the vicinity of the annular portion 83 as the drive input portion, the contact pressure between the guide protrusion 301 and the guide projecting piece 302 of the guide mechanism 300 is increased, the toner is likely to aggregate due to rubbing of both of the protrusion and the piece in a case where the toner is interposed between the both of the protrusion and the piece. Hence, even when the toner is reused, there is a concern that the toner will not appropriate to be reused. In particular, in a state in which an amount of toner exiting from the cleaning device 20 is rapidly increased, such as sheet jam occurs in the image forming apparatus, printing having high image density is performed, or vibration is applied to a process cartridge due to sheet replacement or the like, there is a concern that it will be easy for the aggregation of the toner described above to occur.

In this respect, in the present exemplary embodiment, since the guide protrusion 101 of the guide mechanism 100 and the guide pin 107 are disposed to be separated by a distance from the annular portion 83 as the drive input portion, the contact pressure between the guide protrusion 101 and the guide pin 107 is necessarily reduced depending on a moment length, and thus there is less concern that the toner interposed between the guide protrusion 101 and the guide pin 107 will be aggregation by the rubbing due to the excessive contact pressure.

(Second Exemplary Embodiment)

Figure 20:
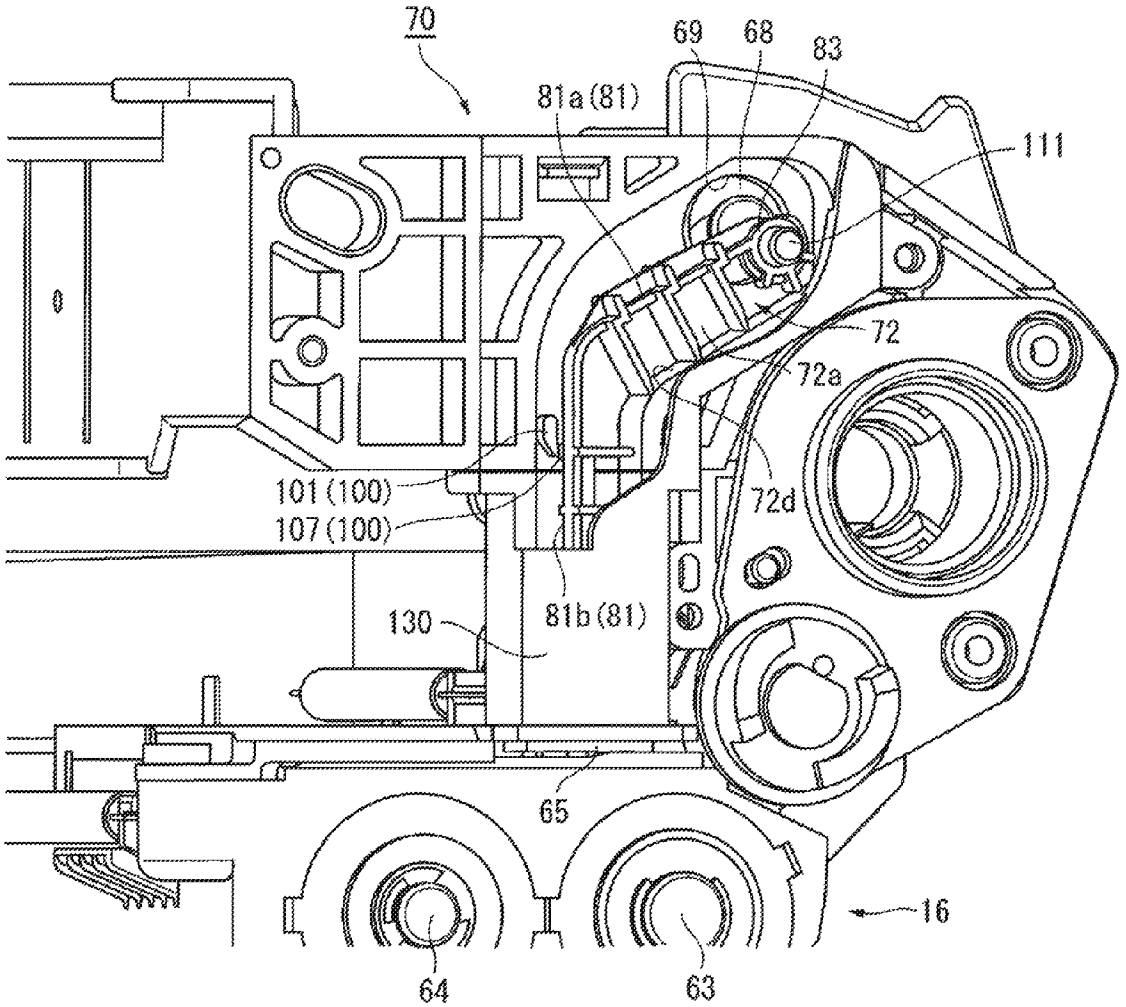
FIG. 20 is a view depicting main parts of a toner returning mechanism according to a second exemplary embodiment.

FIG. 20 illustrates main parts of the toner returning mechanism according to the second exemplary embodiment;

In FIG. 20, a basic configuration of the toner returning mechanism 70 is substantially the same as in the first exemplary embodiment and the guide mechanism 100 is different from that in the first exemplary embodiment. Note that the same reference signs as in the first exemplary embodiment are assigned to the same components as in the first exemplary embodiment, and description thereof is omitted.

Figure 21:
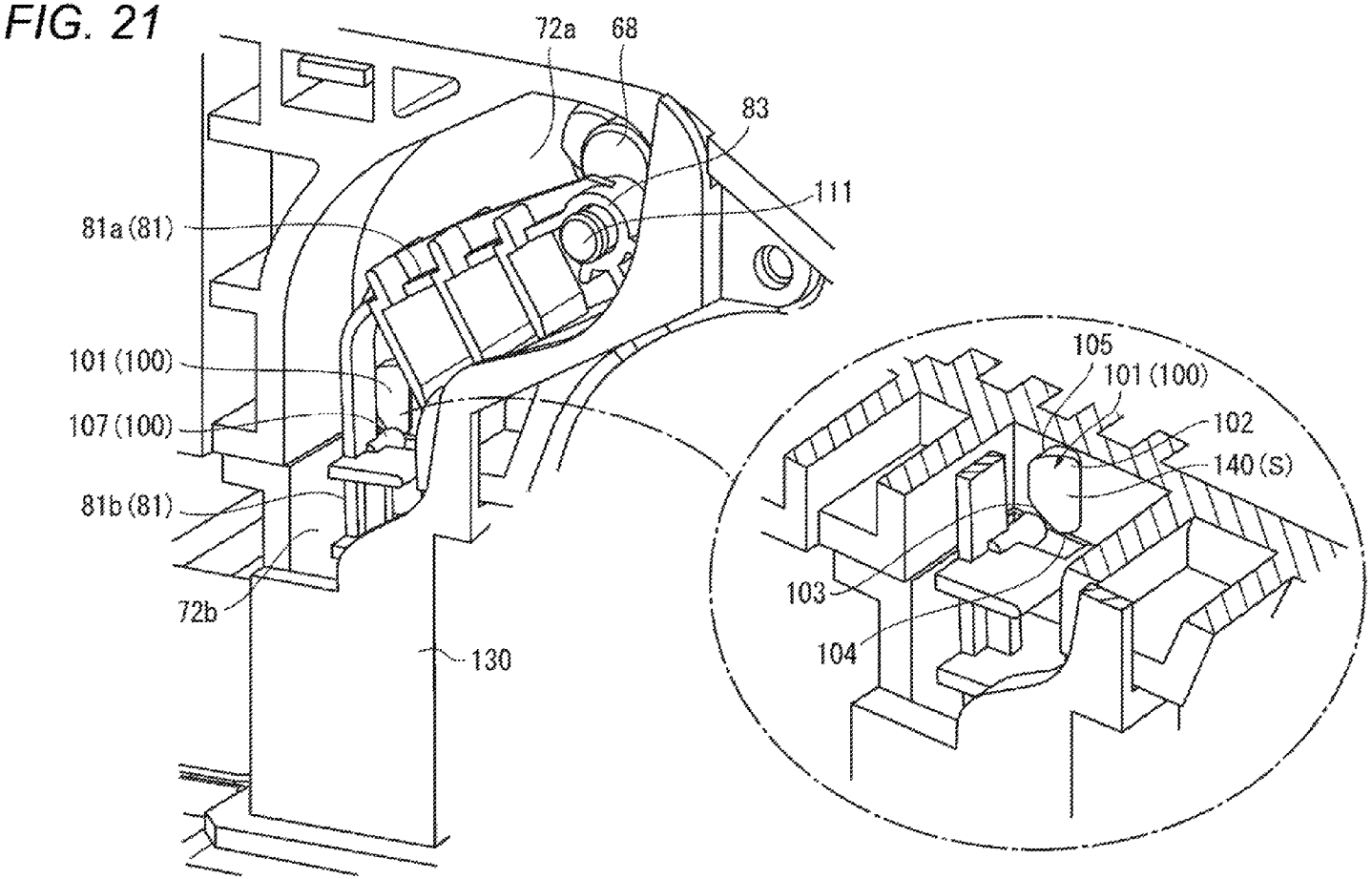
FIG. 21 is a view depicting a peripheral structure and main parts of a regulation member used in the toner returning mechanism according to the second exemplary embodiment.

In the exemplary embodiment, similarly to the first exemplary embodiment, the guide mechanism 100 has a guide protrusion 101 and the guide pin 107; however, unlike the first exemplary embodiment, as illustrated in FIGS. 20 and 21, the guide protrusion 101 has a cross-sectional shape of a substantial triangle S.

Figure 22B:
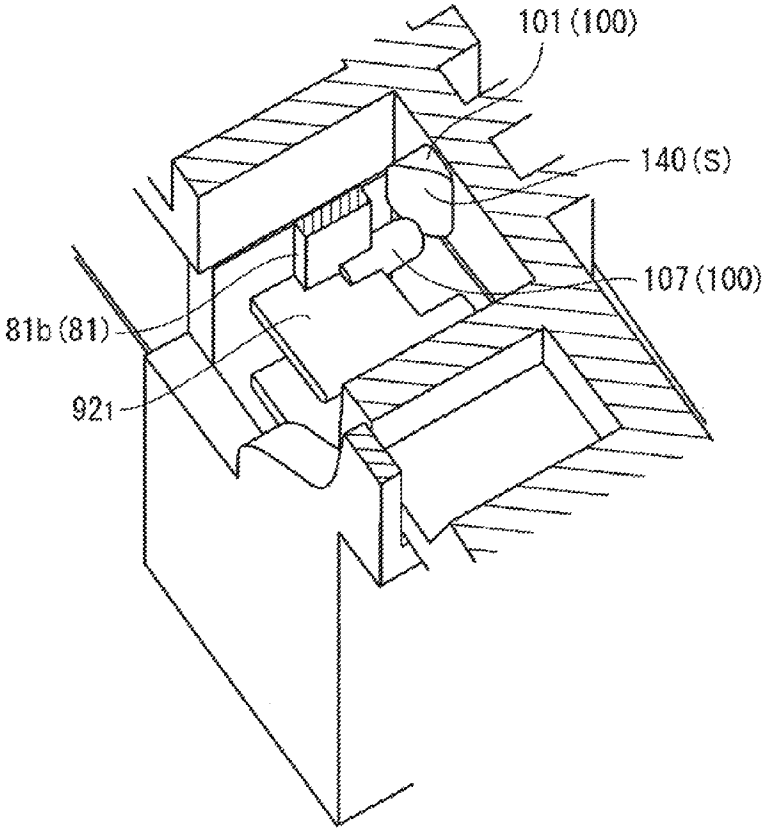
FIGS. 22A and 22B are views depicting engagement between the regulation member and a regulation-target portion of a transport member used in the second exemplary embodiment.
Figure 22A:
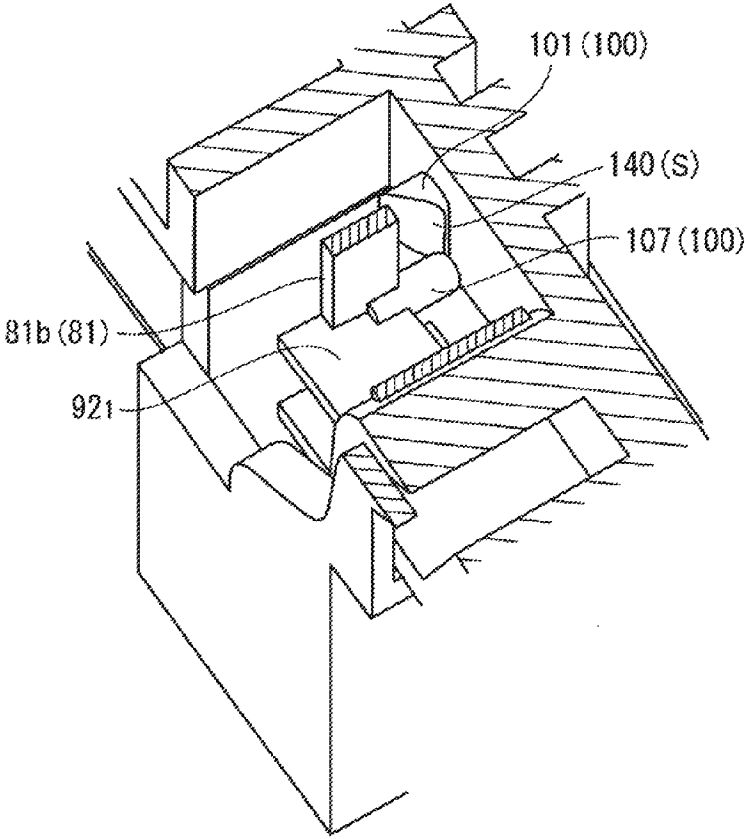

Therefore, in the guide mechanism 100 according to the present exemplary embodiment, as illustrated in FIGS. 22A and 22B, the guide pin 107 runs over the guide protrusion 101 and moves to the back side (corresponding to a side opposite to the lateral direction transport member 81*a*) of the guide protrusion 101. Since the guide protrusion 101 has the cross-sectional shape of a substantial triangle S, an inclined portion 140 from a front side toward a rear side of the guide protrusion 101 functions as a guiding surface of the guide pin 107. Thus, compared to the first exemplary embodiment, it is preferable that the hooking resistance of the guide pin 107 with respect to the guide protrusion 101 is further reduced. Note that, since the guide pin 107 is reliably stopped at a step wall of the guide protrusion 101 on the rear side of the guide protrusion 101, there is no concern that the guide pin 107 is inadvertently pulled out of the guide protrusion 101 and the behavior of the transport members 81 is sufficiently maintained by the guide mechanism 100.

(Third Exemplary Embodiment)

Figure 23:
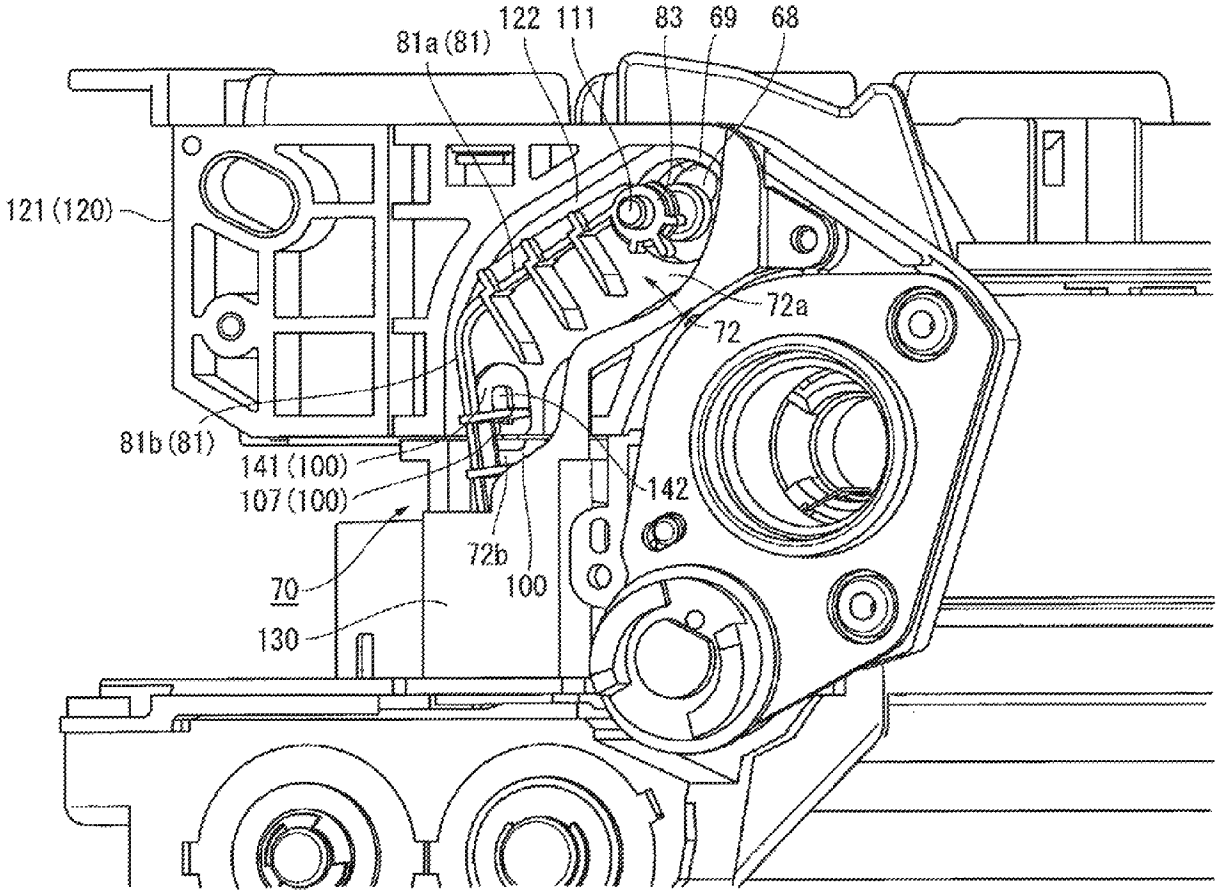
FIG. 23 is a view depicting main parts of a toner returning mechanism according to a third exemplary embodiment.

FIG. 23 illustrates main parts of a toner returning mechanism according to the third exemplary embodiment.

In FIG. 23, a basic configuration of the toner returning mechanism 70 is substantially the same as in the first exemplary embodiment and the guide mechanism 100 is different from the first exemplary embodiment. Note that the same reference signs as in the first exemplary embodiment 1 are assigned to the same components as in the first exemplary embodiment, and description thereof is omitted.

Figure 24:
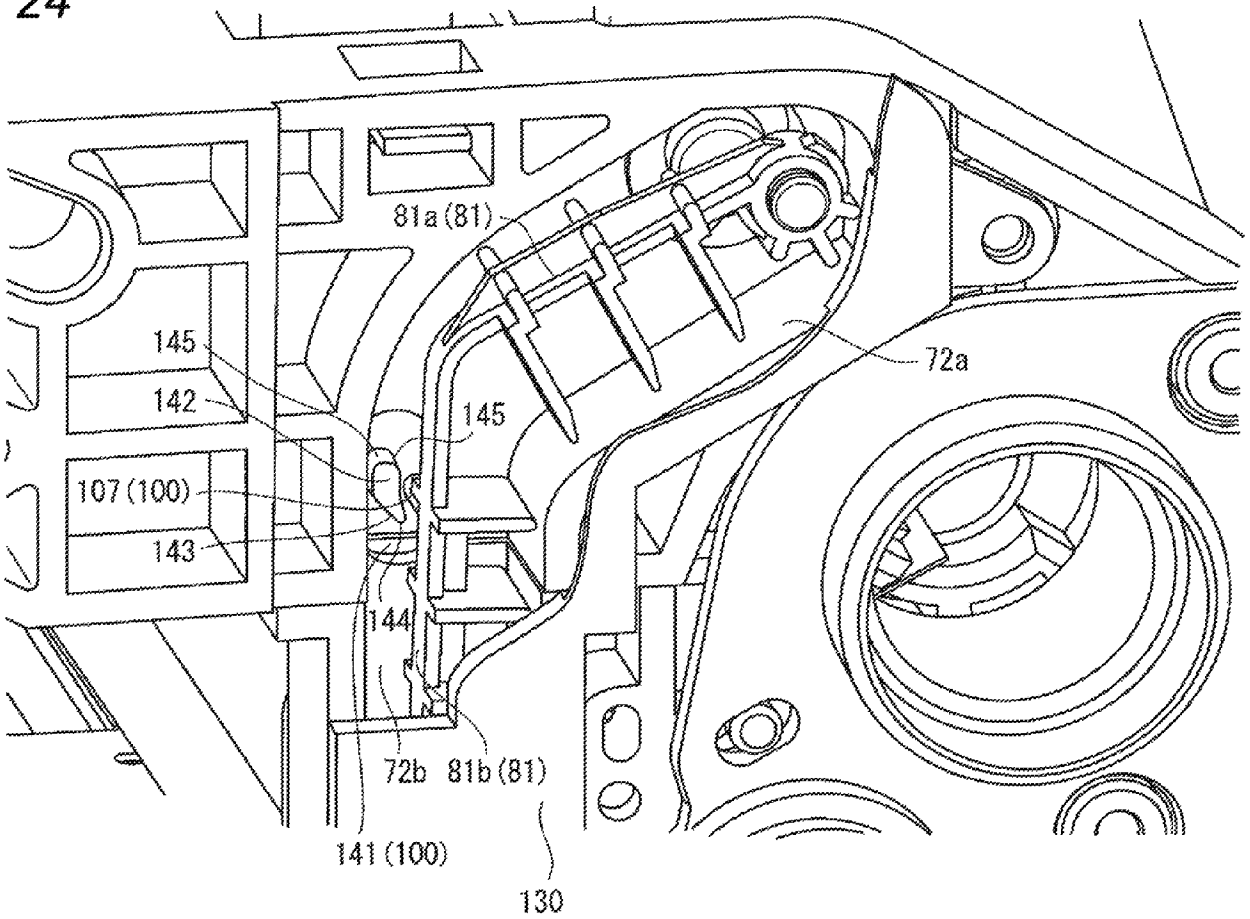
FIG. 24 is a view depicting a peripheral structure of a regulation member used in the toner returning mechanism according to the third exemplary embodiment.
Figure 25A:
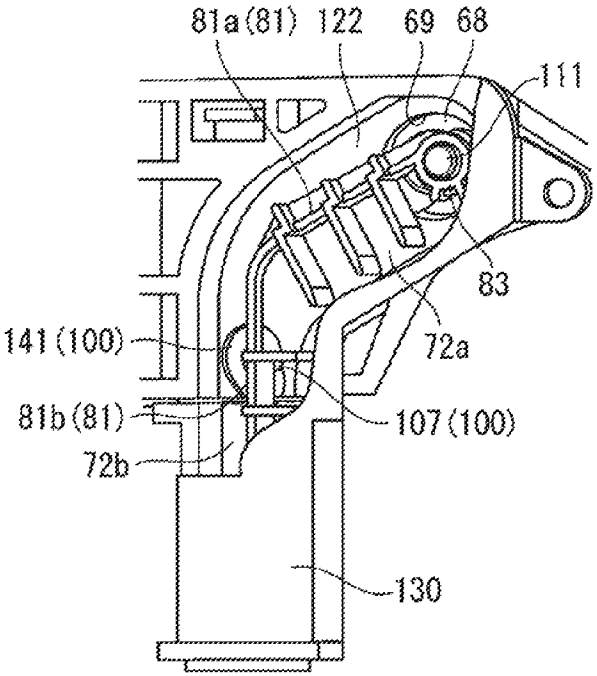
FIGS. 25A to 25C are views depicting a positional change (1) of the regulation member and a regulation-target portion in an operation process of a transport member used in a third exemplary embodiment.
Figure 25B:
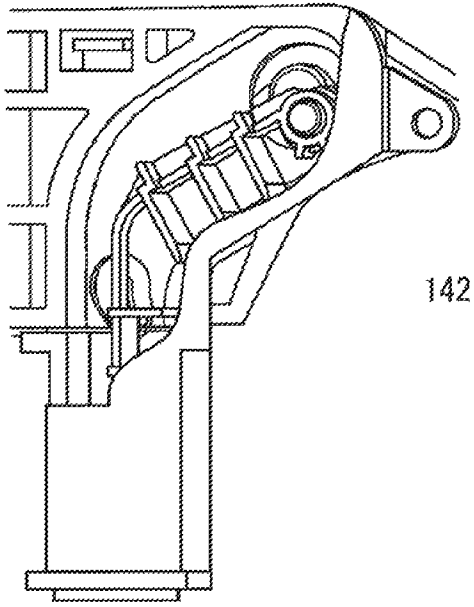
Figure 25C:
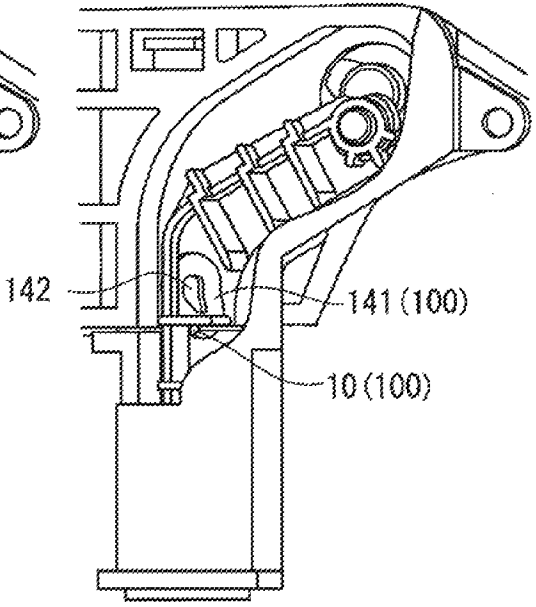
Figure 26A:
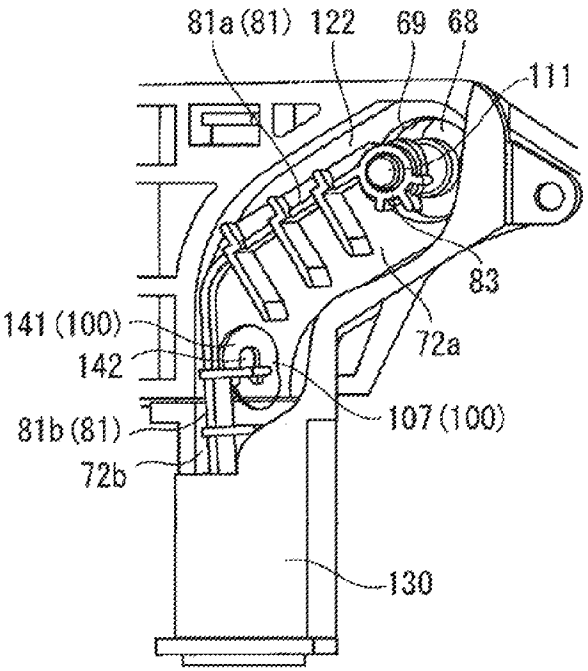
FIGS. 26A to 26C are views depicting a positional change (2) of the regulation member and the regulation-target portion in the operation process of the transport member used in the third exemplary embodiment.
Figure 26B:
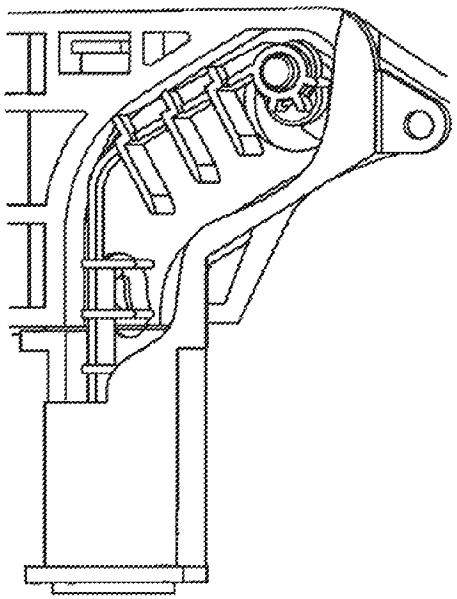
Figure 26C:
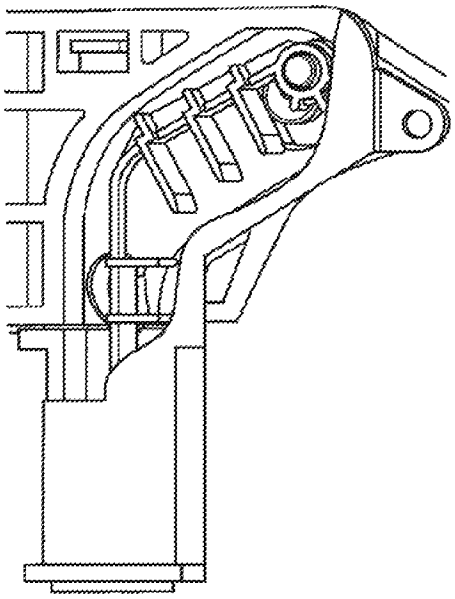

In the example, similarly to the first exemplary embodiment, the guide mechanism 100 has the guide pin 107 formed on the longitudinal-direction transport member 81*b* of the transport members 81; however, unlike the first exemplary embodiment, as illustrated in FIGS. 23 and 24, the guide groove portion 141 is formed to move around in the bottom of the recess 122 of the cartridge housing 120 of the duct member 71 that partitions the longitudinal-direction transport path 72*b*.

In the example, by the guide groove portion 141, an insular portion 142 having the same shape as the guide protrusion 101 of the first exemplary embodiment remains at the central portion, and a recessed portion, in which the guide pin 107 can move around the insular portion 142, is formed. The insular portion 142 includes an inclined portion 143, and curved portions 144 and 145 which correspond to the inclined portion 103, and the curved portions 104 and 105 which are similar to the guide protrusion 101.

In addition, in the example, as shown in a virtual line in FIG. 9B, a pressing pad 133 having elasticity is provided inside a cover portion 131 of the partition member 130 that configures the duct member 71, so as to lightly press the transport members 81.

According to present exemplary embodiment, as illustrated in FIGS. 25A to 26C, in the toner returning mechanism 70, the transport members 81 (lateral direction transport member 81*a* and longitudinal-direction transport member 81*b*) repeat the reciprocating movement in response to the drive from the drive input portion. At this time, the guide mechanism 100 regulates the behavior of the transport members 81 through the operations in FIGS. 25A to 25C and FIGS. 26A to 26C.

Note that, in the present exemplary embodiment, since the guide groove portion 141 is formed is formed in a shape of being recessed further from the bottom of the recess 122 of the cartridge housing 120, as in the first and second exemplary embodiments, there is no need to provide the notch 108 in the vicinity of the guide pin 107 on the transport members 81 (in the example, longitudinal-direction transport member 81*b*) side.

(Fourth Exemplary Embodiment)

Figure 27:
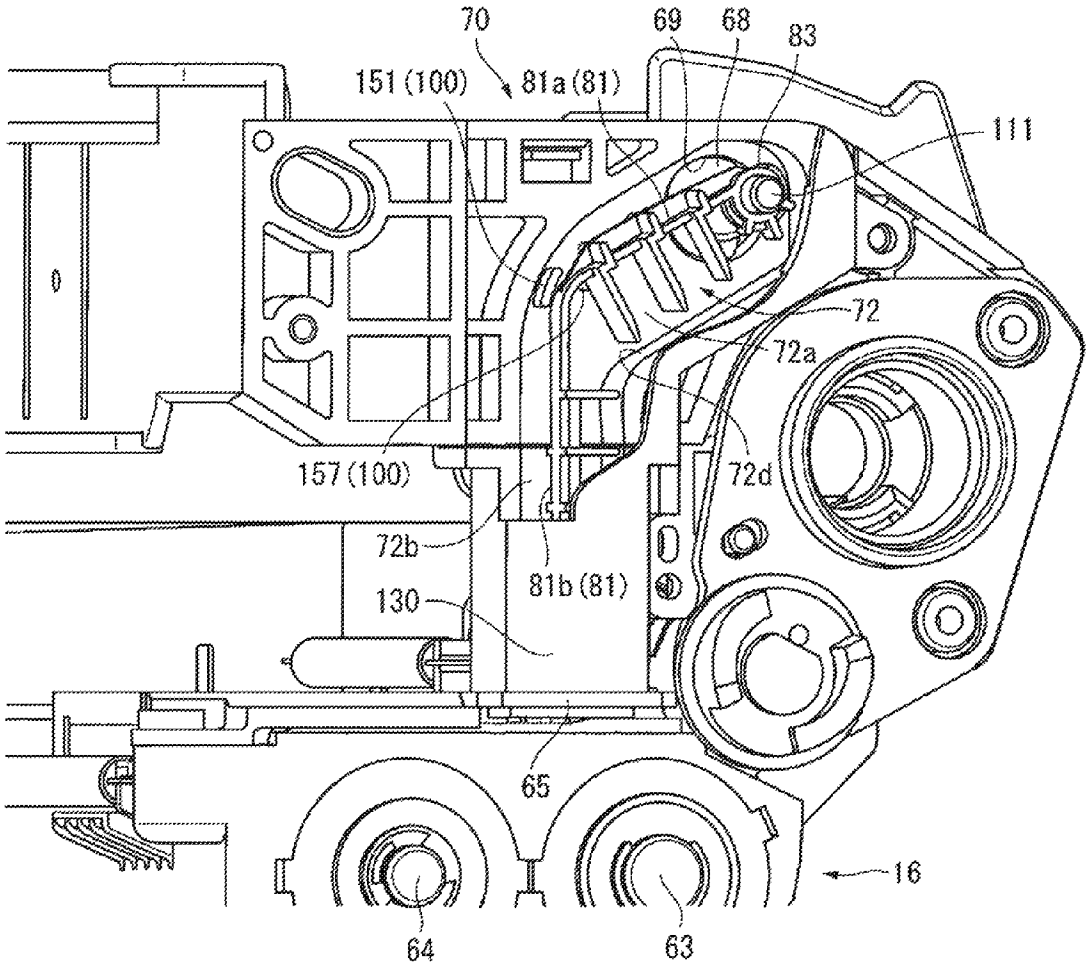
FIG. 27 is a view depicting main parts of a toner returning mechanism according to a fourth exemplary embodiment.
Figure 28A:
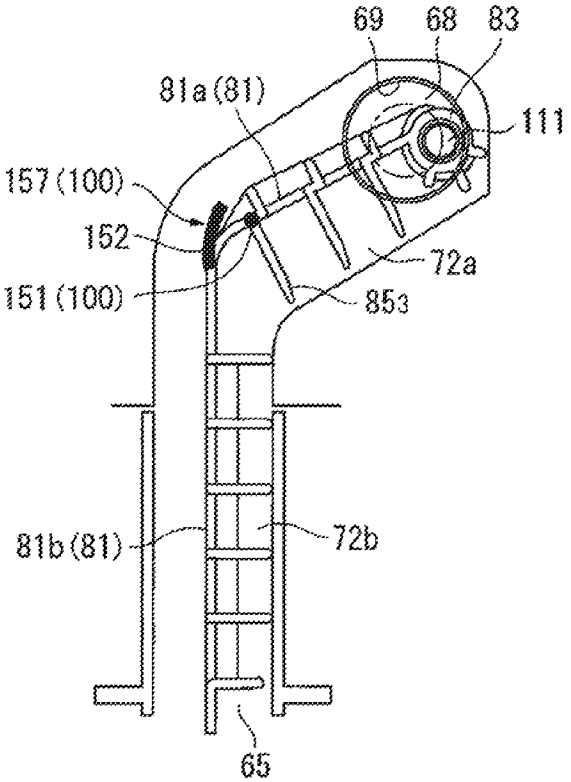
FIGS. 28A to 28C are views depicting a positional change (1) of a regulation member and a regulation-target portion in an operation process of a transport member used in the fourth exemplary embodiment.
Figure 28B:
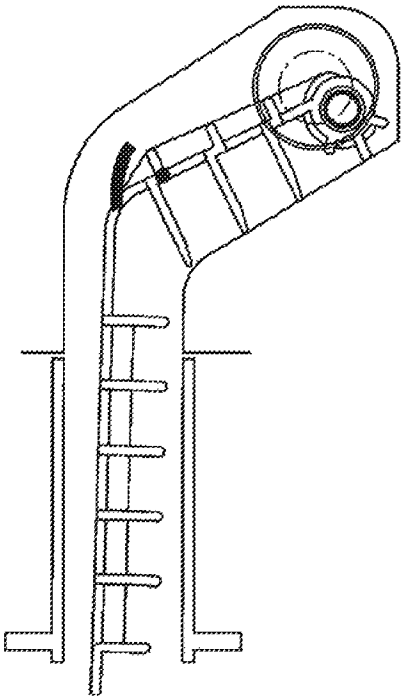
Figure 28C:
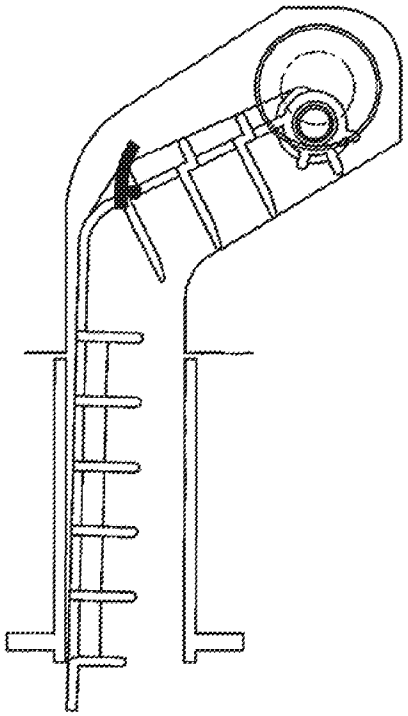

FIG. 27 illustrates main parts of a toner returning mechanism according to the fourth exemplary embodiment;

In FIG. 27, a basic configuration of the toner returning mechanism 70 is substantially the same as in the first exemplary embodiment, but the guide mechanism 100 is disposed at a different position from that in the first exemplary embodiment. Note that the same reference signs as in the first exemplary embodiment are assigned to the same components as in the first exemplary embodiment, and description thereof is omitted.

In FIG. 27, the guide mechanism 100 is formed in the upper space facing the longitudinal-direction transport path 72*b*, as illustrated in FIG. 27, a guide protrusion 151 is formed to protrude from the bottom of the duct member 71, which partitions the longitudinal-direction transport path 72*b*, of the bottom of the recess 122 of the cartridge housing 120, and a guide pin 157 is formed to protrude toward the bottom of the recess 122 at a coupled position of the vane member $\mathbf{85}_3$, which is positioned at the end of the lateral direction transport member 81*a* on the downstream side, with the plate-shaped base member 82. The guide protrusion 151 engages with the guide pin 157, thereby causing the guide pin 157 to move around the guide protrusion 151.

In this manner, the behavior of a portion of the guide pin 157 of the lateral direction transport member 81*a* is regulated, and the behavior of the transport members 81 (lateral direction transport member 81*a* and longitudinal-direction transport member 81*b*) is regulated.

In the example, the guide protrusion 151 has a rod-shaped convex portion 152 of which an upper portion has a curved shape, and the lowest position of the guide protrusion 151 is lower than the lowest position of the guide pin 157 of the lateral direction transport member 81*a*.

Hence, according to the present exemplary embodiment, as illustrated in FIGS. 28A to 30C, in the toner returning mechanism 70, the transport members 81 (lateral direction transport member 81*a* and longitudinal-direction transport member 81*b*) repeat the reciprocating movement in response to the drive from the drive input portion. At this time, the guide mechanism 100 regulates the behavior of the transport members 81 through the operations in FIGS. 28A to 28C, further, FIGS. 29A to 29C, and FIGS. 30A to 30C.

Figure 29A:
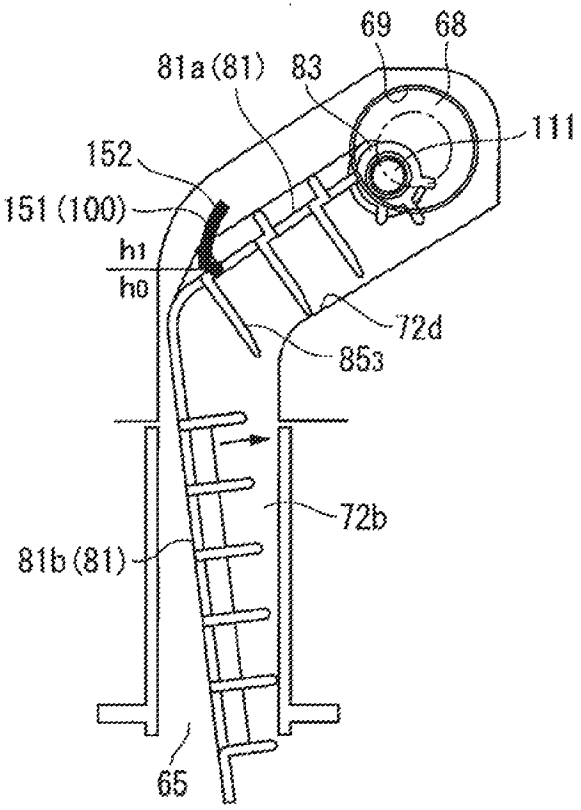
FIGS. 29A to 29C are views depicting a positional change (2) of the regulation member and the regulation-target portion in the operation process of the transport member used in the fourth exemplary embodiment.
Figure 29B:
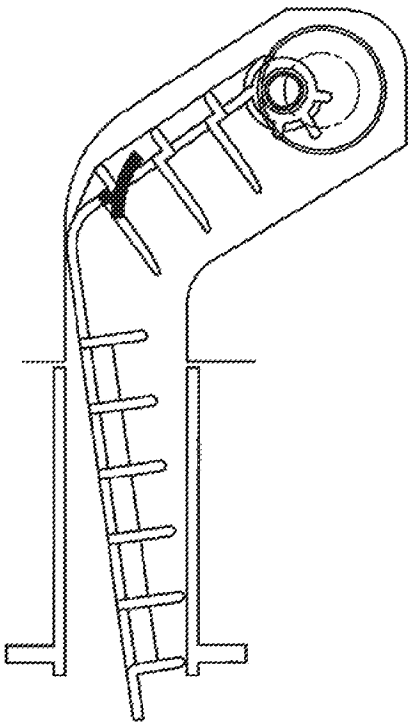
Figure 29C:
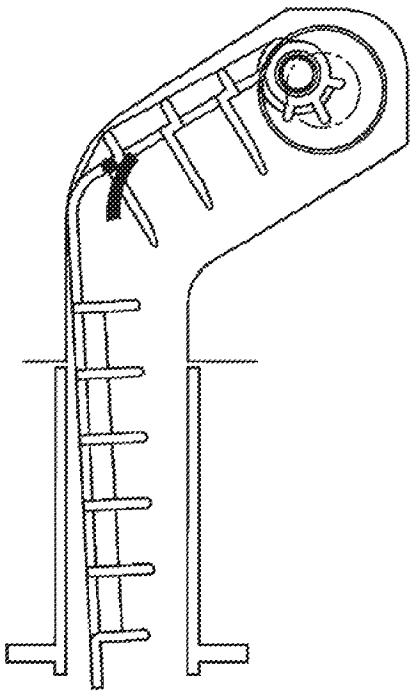
Figure 30A:
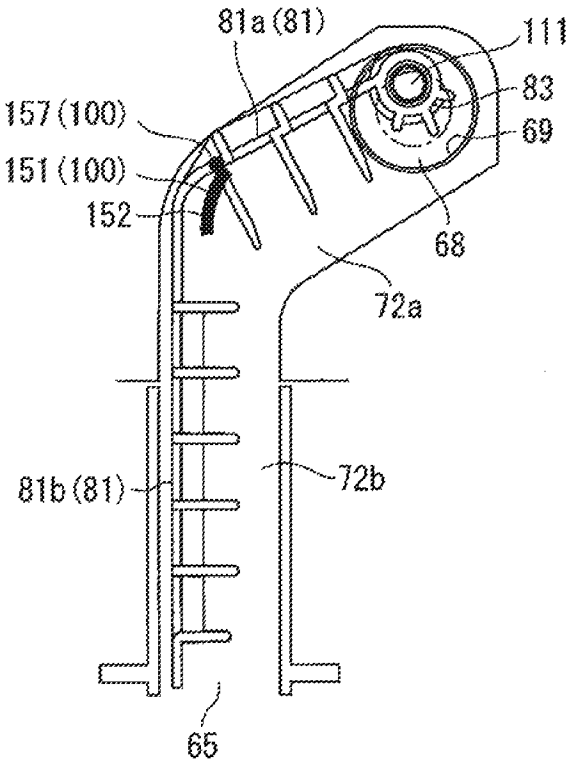
FIGS. 30A to 30C are views depicting a positional change (3) of the regulation member and the regulation-target portion in the operation process of the transport member used in the fourth exemplary embodiment.
Figure 30B:
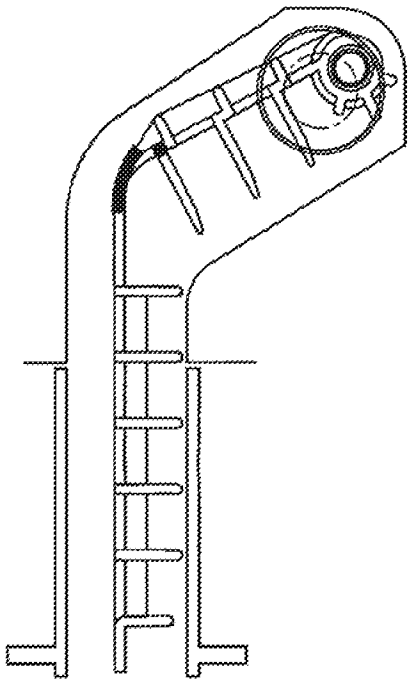
Figure 30C:
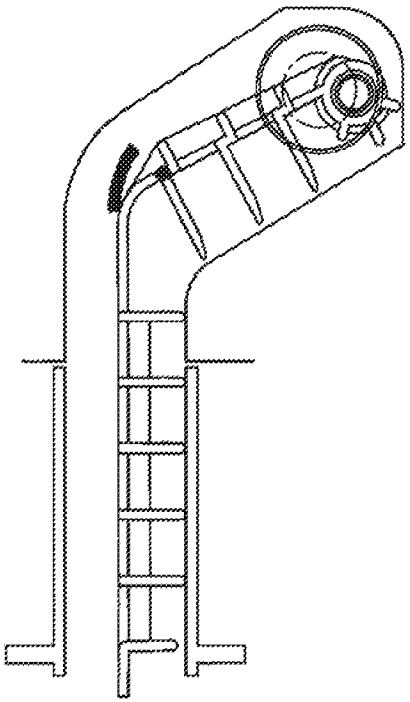

In particular, in the present exemplary embodiment, as illustrated in FIG. 29A, since the lowest end position h1 of the guide protrusion 151 is set to be lower than the lowest end position h0 of the guide pin 157, the guide pin 157 passes through the lower end portion of the guide protrusion 151 in a non-contact or light-contact state without being caught on the lower end portion of the guide protrusion 151 when the guide pin passes through the lower end portion of the guide protrusion 151.

(Fifth Exemplary Embodiment)

Figure 31:
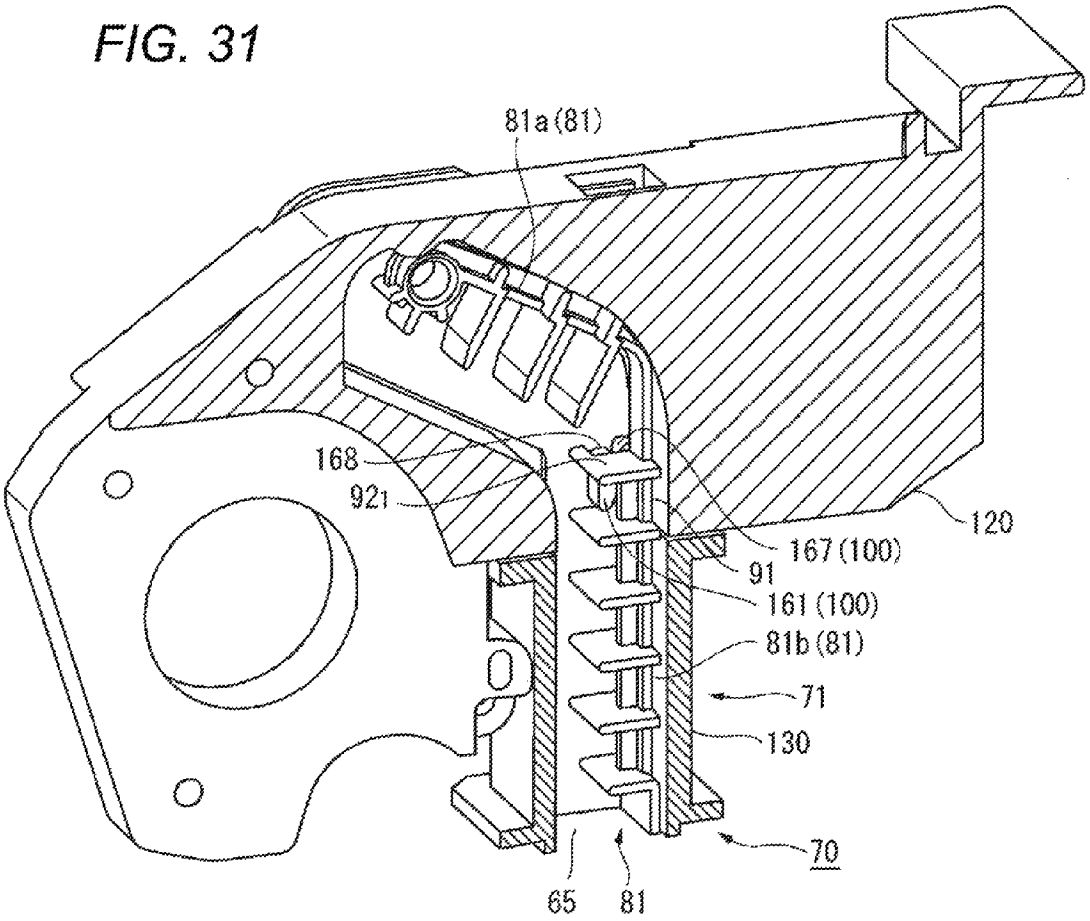
FIG. 31 is a view depicting main parts of a toner returning mechanism according to a fifth exemplary embodiment.

FIG. 31 illustrates main parts of a toner returning mechanism according to the fifth exemplary embodiment.

In FIG. 31, a basic configuration of the toner returning mechanism 70 is substantially the same as in the first exemplary embodiment, but the guide mechanism 100 is disposed at a different position from that in the first exemplary embodiment. Note that the same reference signs as in the first exemplary embodiment are assigned to the same components as in the first exemplary embodiment, and description thereof is omitted.

Figure 32A:
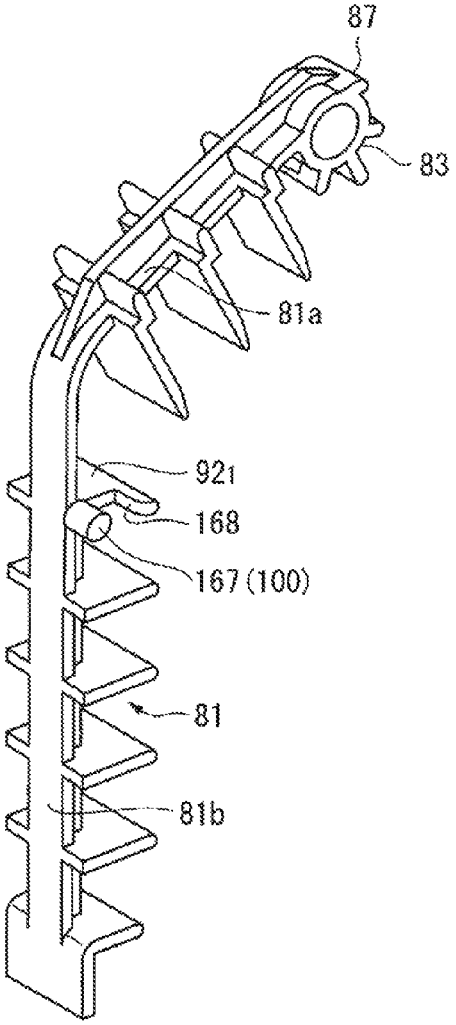
FIG. 32A is a view depicting a transport member and a regulation-target portion used in the fifth exemplary embodiment.
Figure 32B:
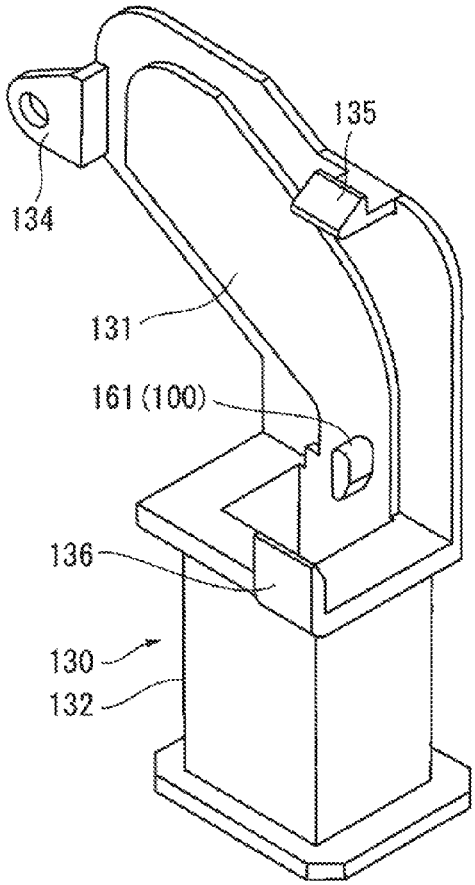
FIG. 32B is a view depicting a regulation member and a partition member which partitions a returning transport path.

In the example, similar to the first exemplary embodiment, the guide mechanism 100 is formed in the upper space facing the longitudinal-direction transport path 72*b*; however, unlike Exemplary Embodiment 1, as illustrated in FIGS. 31, 32A, and 32B, a guide protrusion 161 is formed to protrude from an inner surface of the cover portion 131, on the inside of the cover portion 131 of the partition member 130 mounted in the cartridge housing 120, of the duct member 71, which partitions the longitudinal-direction transport path 72*b*, and a guide pin 167 is formed to protrude toward the cover portion 131 of the partition member 130 at a coupled position of the vane member $\mathbf{92}_1$, which is positioned at the top end of the longitudinal-direction transport member 81*b*, with the plate-shaped base member 91. The guide protrusion 161 engages with the guide pin 167, thereby causing the guide pin 167 to move around the guide protrusion 161. In this manner, the behavior of a portion of the guide pin 167 of the longitudinal-direction transport member 81*b* is regulated, and the behavior of the transport members 81 (lateral direction transport member 81*a* and longitudinal-direction transport member 81*b*) is regulated.

Note that, in FIG. 31, reference number 168 represents a notch that is formed by notching a portion of the guide vane $\mathbf{92}_1$ in the vicinity of the guide pin 167 so as to prevent interference with the guide protrusion 161.

In addition, in the present exemplary embodiment, as illustrated in FIG. 32A, substantially similar to the first to fourth exemplary embodiments, in the lateral direction transport member 81*a*, plural assist vane members 87, which radially extend, are arranged around the annular portion 83 at appropriate intervals. Unlike the first to fourth exemplary embodiments, further, one assist vane member 87 protrudes on the upper side of the annular portion 83 toward an inner wall surface on the upstream side of the lateral direction transport path 72*a*, and a total of four assist vane members 87 effectively scrape the toner attached on the inner wall surface on the upstream side of the lateral direction transport path 72*a*. Note that it is needless to say that the same assist vane member 87 may be provided also in the lateral direction transport member 81*a* of the first to fourth exemplary embodiments.

(Sixth Exemplary Embodiment)

Figure 33:
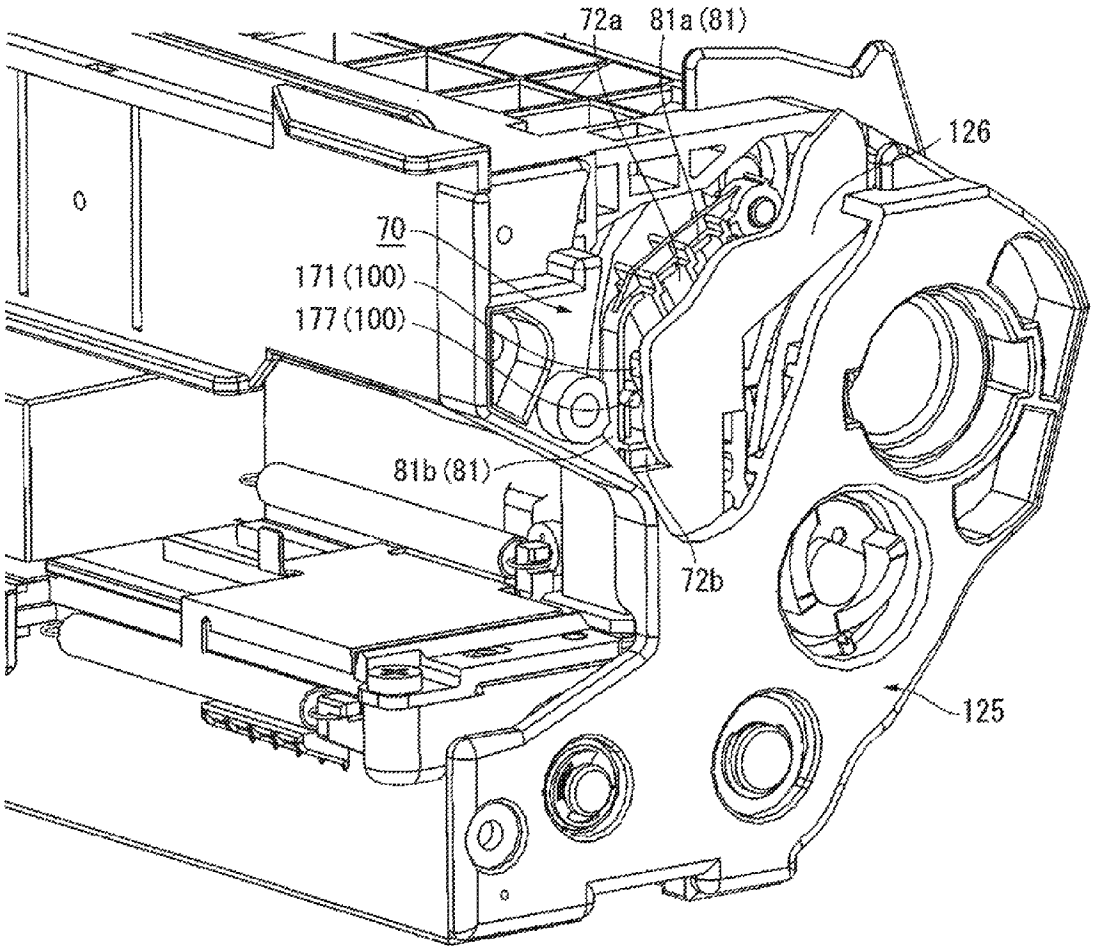
FIG. 33 is a view depicting main parts of a toner returning mechanism according to a sixth exemplary embodiment.

FIG. 33 illustrates main parts of a toner returning mechanism according to the sixth exemplary embodiment.

In FIG. 33, a basic configuration of the toner returning mechanism 70 is substantially the same as in the fifth exemplary embodiment, but the guide mechanism 100 is disposed at a different position from that in the fifth exemplary embodiment. Note that the same reference signs as in the fifth exemplary embodiment are assigned to the same components as in the fifth exemplary embodiment, and description thereof is omitted.

Figure 34:
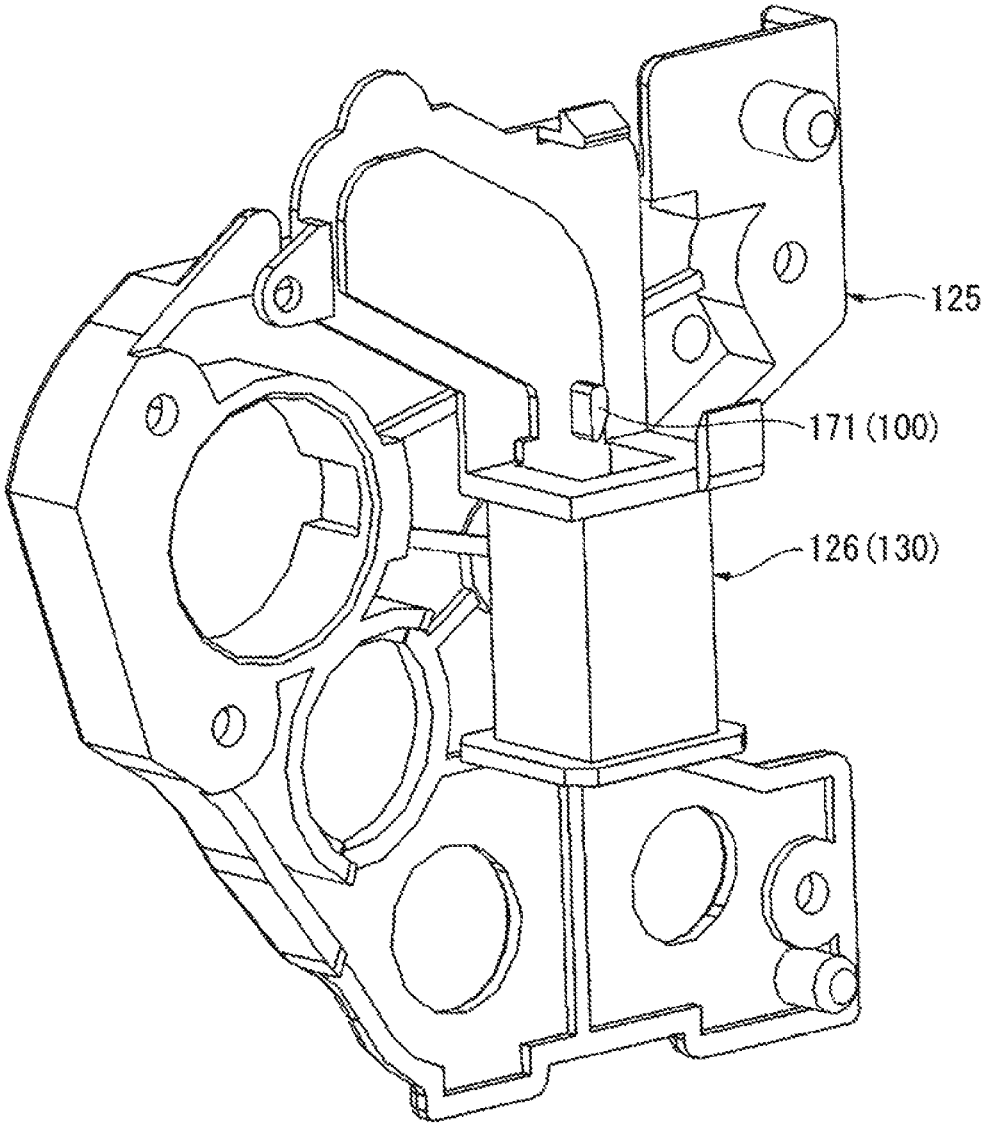
FIG. 34 is a view depicting a partition cover portion that partitions a returning transport path of the toner returning mechanism according to the sixth exemplary embodiment.
Figure 35:
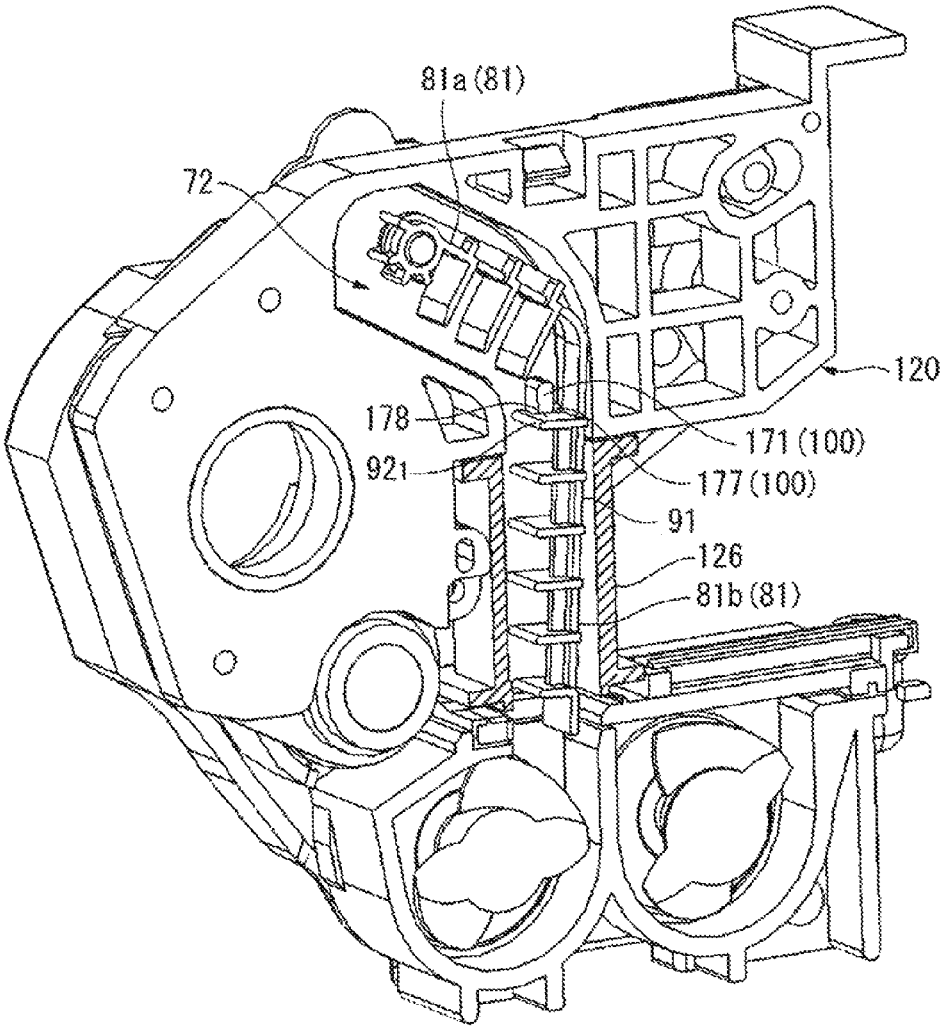
FIG. 35 is a view depicting a transport member, a regulation-target portion, and a regulation member used in the sixth exemplary embodiment.

In the example, similar to the fifth exemplary embodiment, the guide mechanism 100 is formed in the upper space facing the longitudinal-direction transport path 72*b;* however, unlike the fifth exemplary embodiment, as illustrated in FIG. 34, a partition cover portion 126 corresponding to a partition member 130 used in the fifth exemplary embodiment in an external cover 125, and a guide protrusion 171 is formed to protrude from an inner surface of a partition cover portion 126, on the inside of the partition cover portion 126. As illustrated in FIGS. 33 and 35, the transport members 81 are disposed in the returning transport path 72 which is partitioned by the partition cover portion 126, and a guide pin 177 is formed to protrude toward the partition cover portion 126 at a coupled position of the vane member $\mathbf{92}_1$, which is positioned at the top end of the longitudinal-direction transport member 81*b*, with the plate-shaped base member 91. A notch 178, which prevents interference with the guide protrusion 171, is formed on the guide vane $\mathbf{92}_1$. The guide protrusion 171 engages with the guide pin 177, thereby causing the guide pin 177 to move around the guide protrusion 171. In this manner, the behavior of a portion of the guide pin 177 of the longitudinal-direction transport member 81*b* is regulated, and the behavior of the transport members 81 (lateral direction transport member 81*a* and longitudinal-direction transport member 81*b*) is regulated.

The foregoing description of the exemplary embodiments of the present invention has been provided for the purposes of illustration and description. It is not intended to be exhaustive or to the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder transporting device comprising:

a powder transport path through which a powder loading port, from which powder is loaded in the path, communicates with a powder unloading port disposed with being shifted in a horizontal direction from a position perpendicularly below the powder loading port, and which has a lateral direction transport path extending in a transverse direction including at least a obliquely downward direction from the powder loading port and a longitudinal-direction transport path that is provided on the downstream side of the lateral direction transport path, is disposed to be bent with respect to the lateral direction transport path, and extends in a longitudinal direction including a vertical direction toward the powder unloading port, wherein a bottom surface of the lateral direction transport path and a side surface of the longitudinal-direction transport path that is continuous with the bottom surface of the lateral direction transport path form a powder transport surface;

a powder transport member that includes a lateral direction transport member, which is movable along the lateral direction transport path, and a longitudinal-direction transport member, which is coupled to the lateral direction transport member and is movable along the longitudinal-direction transport path, and that transports powder along the lateral direction transport path and the longitudinal-direction transport path;

a drive input portion on the upstream side of the lateral direction transport member in a transporting direction of the powder, wherein the drive input portion travels along a rotational track; and a regulation member that is provided in an upper space facing the longitudinal-direction transport path of the powder transport path or in an upper half region of the longitudinal-direction transport path, and configured to come into contact with a regulation-target portion formed in a portion of the powder transport member so as to regulate the behavior of the powder transport member, wherein the powder transport member further includes a base member that transmits a driving force from the drive input portion to the lateral direction transport member and the longitudinal-direction transport member, and the regulation member is configured to regulate the behavior of the powder transport member so that the longitudinal-direction transport member is not in contact with the powder transport surface when the longitudinal-direction transport member moves upward in the longitudinal direction including the vertical direction.

2. The powder transporting device according to claim 1, wherein the regulation member regulates the behavior of the powder transport member such that the lateral direction transport member is in contact with the powder transport surface of the lateral direction transport path in a case where the lateral direction transport member moves obliquely downward along the lateral direction transport path, and, except for this case, the lateral direction transport member is not in contact with the powder transport surface of the lateral direction transport path.

3. The powder transporting device according to claim 1, wherein the regulation member is provided at a position of the powder transport path, which is separated by a distance equal to or longer than a distance from the drive input portion to a bent portion between the lateral direction transport member and the longitudinal-direction transport member.

4. The powder transporting device according to claim 1, wherein the regulation member is provided in the powder transport path in the vicinity of the bent portion between the lateral direction transport member and the longitudinal-direction transport member.

5. The powder transporting device according to claim 1, wherein the regulation member is provided above the lowermost position that is reached by the regulation-target portion formed in a portion of the lateral direction transport member.

6. The powder transporting device according to claim 1, wherein the regulation member is provided on a wall surface, which partitions the powder transport path, and engages with the regulation-target portion formed in a portion of the powder transport member so as to regulate the behavior of the powder transport member.

7. The powder transporting device according to claim 1, wherein the regulation member is configured of a protrusion protruding from a wall surface, which partitions the powder transport path, and causes the regulation-target portion formed in a portion of the powder transport member to move around the protrusion so as to regulate the behavior of the powder transport member.

8. The powder transporting device according to claim 1, wherein the regulation member is configured of a recessed groove portion along a circulation track that is predetermined in a wall surface, which partitions the powder transport path, and causes the regulation-target portion formed in a portion of the powder transport member to move along the groove portion so as to regulate the behavior of the powder transport member.

9. The powder transporting device according to claim 1, wherein the regulation member is configured of a protrusion protruding from a wall surface, which partitions the powder transport path, and a cross-sectional shape of the protrusion is changed, so that engagement with the regulation-target portion formed in a portion of the powder transport member is adjusted.

10. The powder transporting device according to claim 1, wherein the regulation member is provided on a wall surface, which partitions the powder transport path, and engages with the regulation-target portion formed in a portion of the powder transport member with a track having a curved shape or a corner with an obtuse angle.

11. The powder transporting device according to claim 1, wherein the regulation member is provided on a wall surface, which partitions the powder transport path, engages with the regulation-target portion formed in a portion of the powder transport member, and includes a pressing structure in a state of engagement between the powder transport member and the regulation member.

12. A powder processing apparatus comprising:

a powder processing unit that performs processing using powder; and the powder transporting device according to claim 1 that transports powder which is used in the powder processing unit.

13. The powder processing apparatus according to claim 12, wherein the powder processing unit includes an image holding member that holds an electrostatic latent image, a developing device that develops the electrostatic latent image on the image holding member using toner as the powder, and a cleaning device that cleans residual toner from the image holding member, and wherein the powder transporting device is configured as a toner returning device that loads the toner as the powder cleaned by the cleaning device and unloads the toner as reusing toner to the developing device.

14. The powder transporting device according to claim 1, wherein the regulation member and the regulation-target portion are not in contact with the powder transport surface.

* * * * *